US012239191B2

(12) United States Patent
Morishita

(10) Patent No.: US 12,239,191 B2
(45) Date of Patent: Mar. 4, 2025

(54) BELT ADJUSTING AND HOLDING DEVICE

(71) Applicant: YUGEN KAISHA SANKUSU, Toyoake (JP)

(72) Inventor: Akinori Morishita, Toyoake (JP)

(73) Assignee: YUGEN KAISHA SANKUSU, Toyoake (JP)

( * ) Notice: Subject to any disclaimer, the term of this patent is extended or adjusted under 35 U.S.C. 154(b) by 11 days.

(21) Appl. No.: 18/279,139

(22) PCT Filed: Mar. 1, 2021

(86) PCT No.: PCT/JP2021/007743
§ 371 (c)(1),
(2) Date: Aug. 28, 2023

(87) PCT Pub. No.: WO2022/185383
PCT Pub. Date: Sep. 9, 2022

(65) Prior Publication Data

US 2024/0122306 A1 Apr. 18, 2024

(51) Int. Cl.
*A44B 11/02* (2006.01)
*A44B 11/00* (2006.01)

(52) U.S. Cl.
CPC ..... *A44B 11/008* (2013.01); *Y10T 24/4019* (2015.01); *Y10T 24/45084* (2015.01)

(58) Field of Classification Search
CPC ..... Y10T 24/45084; Y10T 24/4084; Y10T 24/4079; Y10T 24/4019; Y10T 24/47;
(Continued)

(56) References Cited

U.S. PATENT DOCUMENTS 5,170,539 A * 12/1992 Lundstedt ..... A44B 11/266 24/313
5,471,714 A * 12/1995 Olson ..... A44B 11/10 24/171

(Continued)

FOREIGN PATENT DOCUMENTS

EP 1 097 651 A1 5/2001
JP H07-246106 A 9/1995

(Continued)

OTHER PUBLICATIONS

Oct. 16, 2024 Extended European Search Report issued in European Patent Application No. 21928961.8.

(Continued)

*Primary Examiner* — Robert Sandy
*Assistant Examiner* — Michael S Lee
(74) *Attorney, Agent, or Firm* — Oliff PLC

(57) ABSTRACT

A belt adjusting and holding device includes: a device body including a belt insertion part allowing insertion of a belt and an opening section communicating with the belt insertion part; and a belt folding member including a grasping part and a folding-back part to fold back the belt within the opening section. The belt folding-back member is configured to move forward and backward within the device body. Standing wall portions rising in a stepped shape are formed on the upper and lower inner wall surfaces of the belt insertion part. The belt folding-back member is formed with a protrusion, which substantially stepwisely bends the belt between the protrusions and the standing wall portions at a backward position of the belt folding-back member and release the belt at a forward position of the belt folding member.

12 Claims, 24 Drawing Sheets

(58) Field of Classification Search
CPC ..... Y10T 24/4745; Y10T 24/4086; Y10T 24/4736; A44B 11/006; A44B 11/008; A44B 11/10; A44B 11/02; A44B 11/065; A44B 11/2557; A44B 11/2553
See application file for complete search history.

(56) References Cited

U.S. PATENT DOCUMENTS

| | | | | |
|---|---|---|---|---|
| 6,148,486 | A | 11/2000 | Jehara et al. | |
| 7,669,298 | B2 * | 3/2010 | Chen ..... | A44B 11/2549 24/579.11 |
| 2007/0000103 | A1 | 1/2007 | Anscher | |
| 2007/0137009 | A1 * | 6/2007 | Chen ..... | A44B 11/263 24/630 |
| 2008/0168634 | A1 | 7/2008 | Chen et al. | |

FOREIGN PATENT DOCUMENTS

| | | | |
|---|---|---|---|
| JP | H11-178610 | A | 7/1999 |
| JP | 2002-065315 | A | 3/2002 |
| JP | 2012-232076 | A | 11/2012 |
| JP | 2021-037069 | A | 3/2021 |

OTHER PUBLICATIONS

May 11, 2021 International Search Report issued in International Patent Application No. PCT/JP2021/007743.
Aug. 29, 2023 International Preliminary Report on Patentability issued in International Patent Application No. PCT/JP2021/007743.

* cited by examiner

BELT ADJUSTING AND HOLDING DEVICE

CROSS-REFERENCE TO RELATED APPLICATIONS

This is a US national phase application based on the PCT International Patent Application No. PCT/JP2021/007743 filed on Mar. 1, 2021, the entire contents of which are incorporated by reference herein.

TECHNICAL FIELD

The present invention relates to a belt adjusting and holding device, used as for example a buckle of a belt for pants or trousers or a tool for tightening belts or straps of a backpack, a belted bag, a waist pouch, a helmet, etc., and configured to adjust the length of at least one belt or strap and hold the belt or strap with an adjusted length.

BACKGROUND ART

Generally, for a buckle of a belt for pants or trousers or a tool for tightening belts or straps of a backpack, a belted bag, a waist pouch, a helmet, etc., there has been known a belt adjusting and holding device configured to adjust the length of at least one belt or strap and hold the adjusted-length belt or strap. This belt adjusting and holding device is disclosed in for example Patent literatures 1 and 2.

Here, a buckle 100 disclosed in Patent literature 1 includes, as shown in FIG. 25, a buckle body 101 with an opening section 102, in which a striker 103 is inserted in engagement therewith, and the striker 103 is formed, at its a proximal end portion, with a belt folding-back part 105 for folding back a belt 104 wound thereon and a belt locking part 106 for overlapping portions of the folded belt 104 each other, in order to adjust the length of the belt 104. The folding-back part 105 and the locking part 106 are located vertically separately on the front surface side and the back surface side of the buckle 100. The belt 104 folded back by the belt folding-back part 105 is bent at an angle near a right angle by the belt locking part 106 so that the portions of the belt 104 overlap in an upper-lower direction, thereby preventing the adjusted belt 104 from loosening.

A buckle 200 disclosed in Patent literature 2, as shown in FIG. 26, includes a buckle body part 203 with a fixing tool 202 for fixing one end 201*a* of a belt, a resilient plate 204 that resiliently contacts the belt when the other end 201*b* of the belt passes through the buckle body part 203, and a pressing tool 205 that presses the resilient plate 204 against the belt. The pressing tool 205 includes an adjusting mechanism 206 for adjusting the pressure that presses the resilient plate 204 to absorb differences in thickness for each belt. The adjusting mechanism 206 is configured to allow the pressing tool 205 to move in and out when an externally-exposed thickness adjusting knob 207 is rotated by a fingertip.

RELATED ART DOCUMENTS

Patent Documents

Patent Document 1: JP-A-2002-065315
Patent Document 2: JP-A-2012-232076

SUMMARY OF INVENTION

Problems to be Solved by the Invention

However, since the buckle 100 disclosed in Patent literature 1, the belt folding-back part 105 and the belt locking part 106 are located vertically separately on the front surface side and the back surface side, the thickness of the buckle 100 is apt to be excessively large, which may become an obstacle during usage, and the appearance of such buckle 100 is undesirable. In addition, to adjust the length of the belt 104, it is necessary to loosen the pressing force that presses the belt locking part 106 against the overlapping portions of the belt 104 by lifting up the buckle 100 or deforming the belt locking part 106, resulting in troublesome adjusting operations. Moreover, when the belt 104 is not used, no tension acts on the belt 104, and the pressing force of the belt locking part 106 also does not act, so that the belt 104 may be displaced. Therefore, the belt 104 needs to be adjusted again each time it is used and consequently such adjusting operations are cumbersome.

In the buckle 200 disclosed in Patent literature 2, there are provided the resilient plate 204 which resiliently contacts the belt when the other end 201*b* of the belt passes through the buckle body part 203 and the pressing tool 205 which presses the resilient plate 204 against the belt. The pressing tool 205 is provided with the adjusting mechanism 206 for adjusting the force of pressing the resilient plate 204 to absorb the differences in thickness for each belt. Accordingly, every time the other end 201*b* of the belt is removed from the buckle body part 203, the adjusting mechanism 206 has to be operated to adjust the pressing force of the pressing tool 205 acting on the resilient plate 204, resulting in troublesome adjusting operations.

The present disclosure has been made to address the above problems and has a purpose to provide a belt adjusting and holding device configured to easily adjust the length of a belt and hold this adjusted belt without an excessive device thickness, and eliminate the need for readjustment at each time of use.

Means of Solving the Problems (1) To achieve the above-mentioned purpose, one aspect of the present disclosure provides a belt adjusting and holding device configured to adjust to length of at least one belt and hold the adjusted belt, the device comprising: a device body including: a belt insertion part formed in a back end portion and opening in a substantially rectangular shape to allow the belt to be inserted forward; and an opening section having a substantially rectangular shape, communicating with the belt insertion part, and extending through in an upper-lower direction perpendicular to an insertion direction of the belt; and a belt folding-back member having a substantially plate shape configured to move forward and backward in a front-back direction within the device body, the belt folding-back member comprising: a folding-back part configured to allow the belt to wind around a front end and fold backward within the opening section; and a grasping part located on a back end side of the folding-back part and configured to project backward from the belt insertion part together with the folded belt, wherein the belt insertion part includes an upper inner wall surface and a lower inner wall surface which are formed with standing wall portions rising inward in a stepped shape on a side near the opening section and extending almost continuously in a belt width direction between right and left sidewalls, and the folding-back part includes an upper end face and a lower end face, at least one of which is formed with a protrusion, which is disposed near back of the standing wall portion when the belt folding-back member is moved to a backward position, bending the belt into a substantially stepped shape between the protrusion and the standing wall portion, and which is disposed in the opening section when the belt folding-back member is moved to a forward position, releasing the belt from bending.

(2) In the belt adjusting and holding device described in (1), preferably, the upper end face and the lower end face of the folding-back part are parallel to each other, and the protrusion includes: a front wall surface facing forward and vertically extending from the upper end face or the lower end face; and a rear inclined surface inclined obliquely forward at an acute angle relative to the upper end face or the lower end face.

(3) In the belt adjusting and holding device described in (1) or (2), preferably, the protrusion includes a plurality of protrusions provided on the upper end face and the lower end face of the folding-back part, at different positions between the upper and lower end faces in the belt width direction, the standing wall portion formed on the upper inner wall surface is formed with a first raised portion protruding inward at a position facing the protrusion formed on the upper end face of the folding-back part, the standing wall portion formed on the lower inner wall surface is formed with a second raised portion protruding inward at a position facing the protrusion formed on the lower end face of the folding-back part, and the belt folding-back member is configured to move, in an upside-down state, forward and backward in the front-back direction within the device body.

(4) In the belt adjusting and holding device described in (3), preferably, the first raised portion is formed, on a back end side, with a first inclined surface inclined back-upward toward the upper inner wall surface, and the second raised portion is formed, on a back end side, with a second inclined surface inclined back-downward toward the lower inner wall surface.

(5) In the belt adjusting and holding device described in any one of (1) to (4), preferably, the right and left sidewalls of the device body are each formed with a guide groove extending in the front-back direction to allow the belt folding-back member to be movable between the forward position and the backward position, the folding-back part is formed, at right and left outer edges, with guide projections which engage with the guide grooves, and the folding-back part includes right and left portions separated at a center in the belt width direction and joined to each other in a nearly U shape through the grasping part.

(6) The belt adjusting and holding device described in any one of (1) to (5), preferably, further comprises a striker including a proximal end portion to which a belt for length fixation is fixed and a distal end portion formed with a locking pawl, wherein the device body includes a striker housing part on a front end side of the opening section to detachably hold the striker, and an engaging protrusion located in the striker housing part and configured to engage with the locking pawl of the striker.

(7) In the belt adjusting and holding device described in any one of (1) to (5), preferably, the device body includes a belt fixing frame on a front end side of the opening section, the belt fixing frame being configured to fix thereto a belt for length fixation.

(8) In the belt adjusting and holding device described in any one of (1) to (5), preferably, the device body includes a second belt insertion part formed on a front end side of the opening section and opening in a substantially rectangular shape to allow a second belt for length adjustment to be inserted backward, the belt adjusting and holding device further comprises a second belt folding-back member having a substantially plate shape configured to move forward and backward in the front-back direction in the device body, the second belt folding-back member including: a second folding-back part configured to allow the second belt to wind around a back end and fold forward, within the opening section; and a second grasping part located on a front end side of the second folding-back part and configured to project forward from the second belt insertion part together with the folded second belt, the second belt insertion part includes an upper inner wall surface and a lower inner wall surface which are formed with second standing wall portions rising inward in a stepped shape on a side near the opening section and extending almost continuously in the belt width direction between the right and left sidewalls, and the second folding-back part includes an upper end face and a lower end face, at least one of which is is formed with a second protrusion, which is disposed near front of the second standing wall portion when the second belt folding-back member is moved to a forward position, bending the second belt into a substantially stepped shape between the second protrusion and the second standing wall portion, and which is disposed in the opening section when the second belt folding-back member is moved to a backward position, releasing the second belt from bending.

(9) In the belt adjusting and holding device described in (8), preferably, the second protrusion includes a plurality of second protrusions arranged on the upper end face and the lower end face of the second folding-back part, at different positions between the upper and lower end faces in the belt width direction, the second standing wall portion formed on the upper inner wall surface of the second belt insertion part is formed with a third raised portion protruding inward at a position facing the second protrusion formed on the upper end face of the second folding-back part, the second standing wall portion formed on the lower inner wall surface of the second belt insertion part is formed with a fourth raised portion protruding inward at a position facing the second protrusion formed on the lower end face of the second folding-back part, and the second belt folding-back member is configured to move, in an upside-down state, forward and backward in the front-back direction within the second device body.

(10) The belt adjusting and holding device described in any one of (1) to (5), preferably, further comprises a second striker including a proximal end portion to which a third belt for length adjustment is fixed with an adjustable length, and a distal end portion formed with a locking pawl, wherein the device body includes a striker housing part on a front end side of the opening section to detachably hold the second striker, and an engaging protrusion located in the striker housing part and configured to engage with the locking pawl of the second striker.

(11) In the belt adjusting and holding device described in (10), preferably, the proximal end portion of the second striker is provided with a third belt insertion part opening in a substantially rectangular shape to allow the third belt to be inserted backward from a front end portion, and a second opening section having a substantially rectangular shape, communicating with the third belt insertion part, and extending through in the upper-lower direction perpendicular to an insertion direction of the third belt, the belt adjusting and holding device further comprises a third belt folding-back member having a substantially plate shape configured to move forward and backward in the front-back direction in the second striker, the third belt folding-back member including: a third folding-back part configured to allow the third belt to wind around a back end and fold forward, within the second opening section; and a third grasping part located on a front end side of the third folding-back part and configured to project forward from the third belt insertion part together with the folded third belt, the third belt insertion part includes an upper inner wall surface and a lower inner wall surface which are formed with third standing wall portions rising inward in a stepped shape on a side near the second opening section and extending almost continuously in the belt width direction between right and left sidewalls of the second striker, and the third folding-back part includes an upper end face and a lower end face, at least one of which is formed with a third protrusion, which is disposed near front of the third standing wall portion when the third belt folding-back member is moved to a forward position, bending the third belt into a substantially stepped shape between the third protrusion and the third standing wall portion, and which is disposed in the second opening section when the third belt folding-back member is moved to a backward position, releasing the third belt from bending.

(12) In the belt adjusting and holding device described in (11), preferably, the third protrusion includes a plurality of third protrusions arranged on the upper end face and the lower end face of the third folding-back part, at different positions between the upper and lower end faces in the belt width direction, the third standing wall portion formed on the upper inner wall surface of the third belt insertion part is formed with a fifth raised portion protruding inward at a position facing the third protrusion formed on the upper end face of the third folding-back part, the third standing wall portion formed on the lower inner wall surface of the third belt insertion part is formed with a sixth raised portion protruding inward at a position facing the third protrusion formed on the lower end face of the third folding-back part, and the third belt folding-back member is configured to move, in an upside-down state, forward and backward in the front-back direction within the second striker.

Effects of the Invention

According to the present invention, a belt adjusting and holding device can be provided without an excessive device thickness, capable of easily adjusting and holding the length of a belt, thus eliminating the need for readjustment at each time of use.

MODE FOR CARRYING OUT THE INVENTION

A detailed description of embodiments of the present invention will now be given referring to the accompanying drawings. The configurations and the operating manner of a belt adjusting and holding device in a first example of the present embodiment will be described in detail first, and second to fourth examples will be described later with a focus on differences from the first example.

<Belt Adjusting and Holding Device in First Example>

Figure 1:
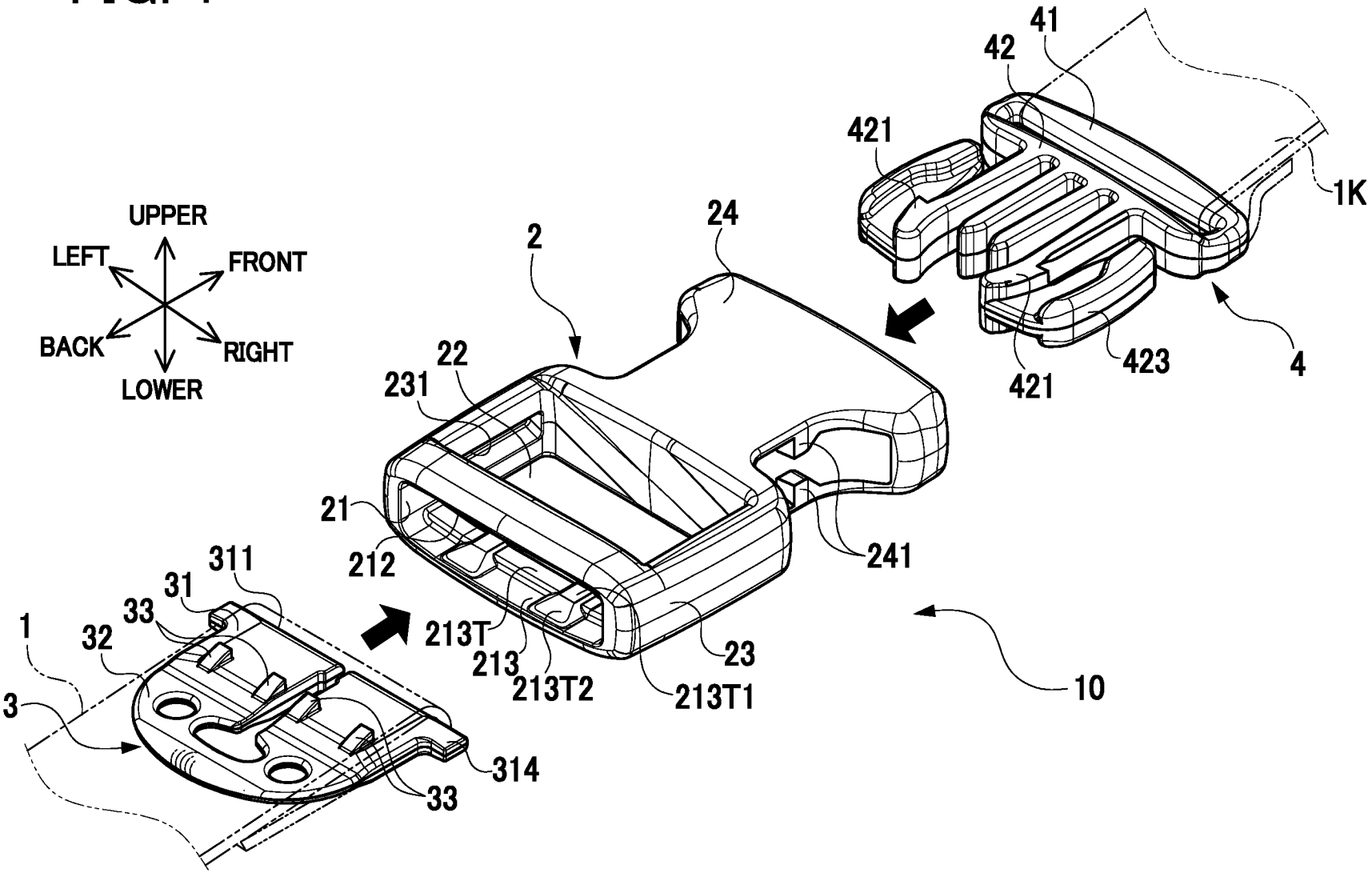
FIG. 1 is a perspective view of a belt adjusting and holding device in an exploded state in a first example of an embodiment.
Figure 2:
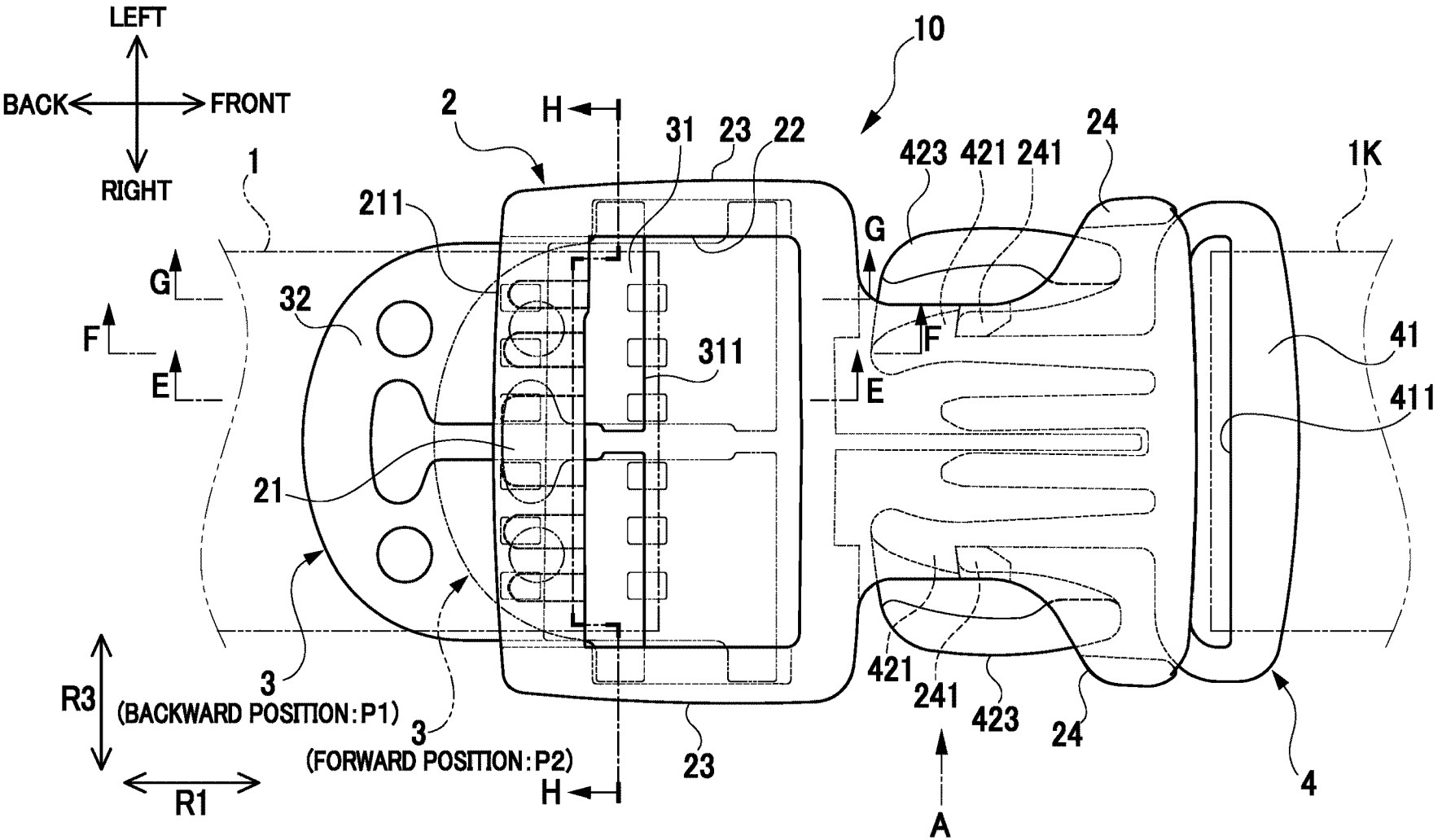
FIG. 2 is a plan view of the belt adjusting and holding device shown in FIG. 1, in an assembled state, i.e., a belt-locking state.
Figure 3:
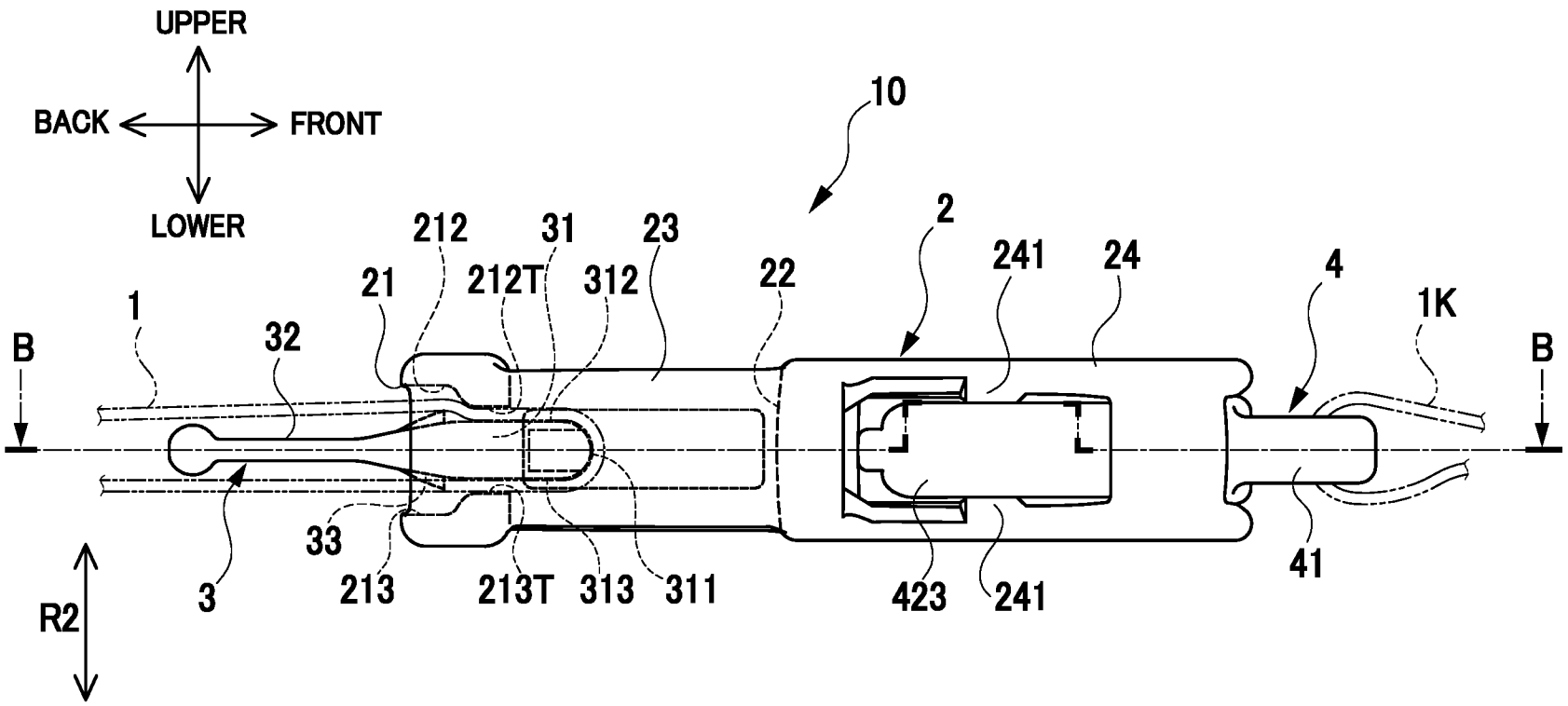
FIG. 3 is a view of the belt adjusting and holding device seen as indicated by an arrow A in FIG. 2.
Figure 4:
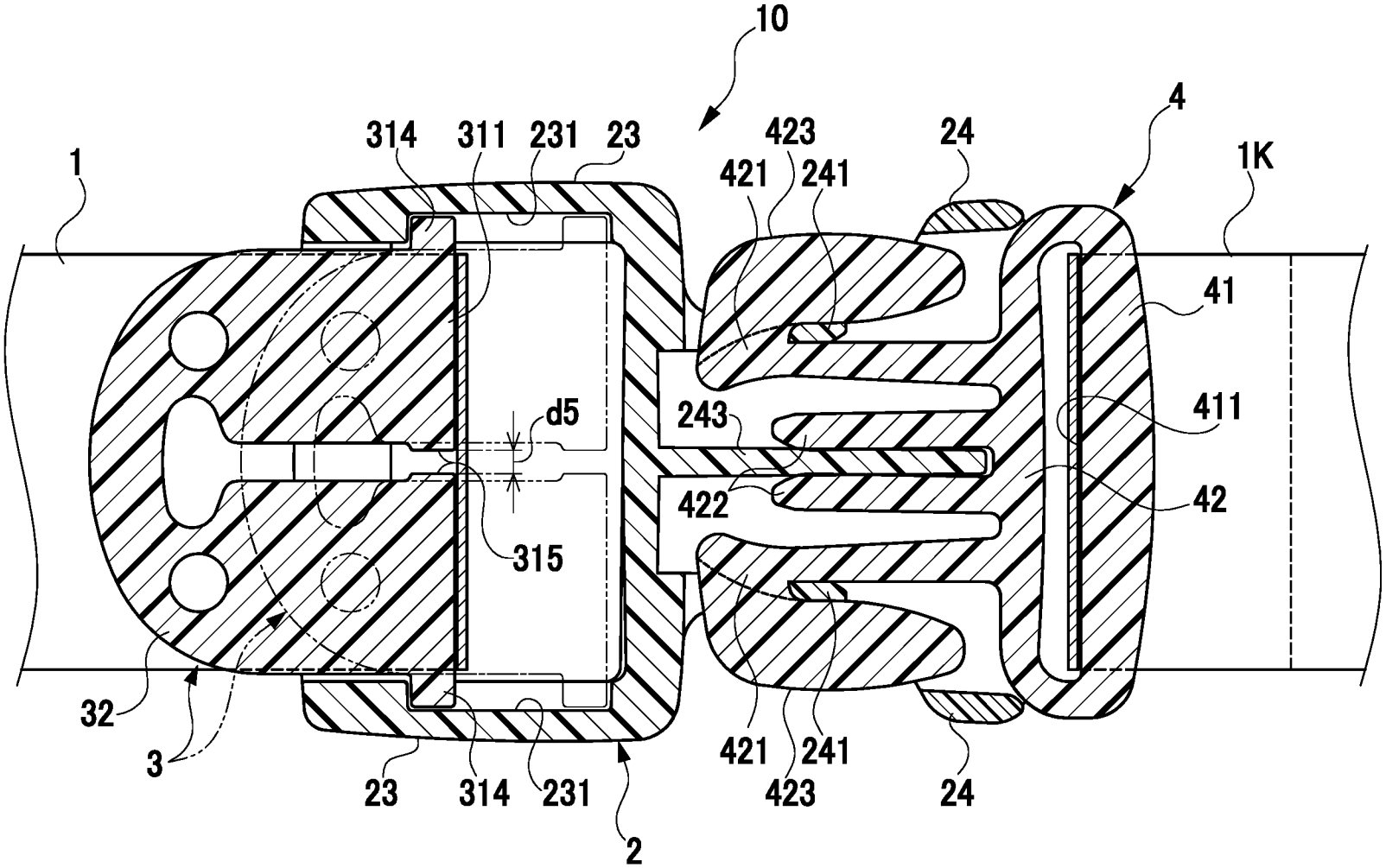
FIG. 4 is a cross-sectional view along B-B in FIG. 3.
Figure 5:
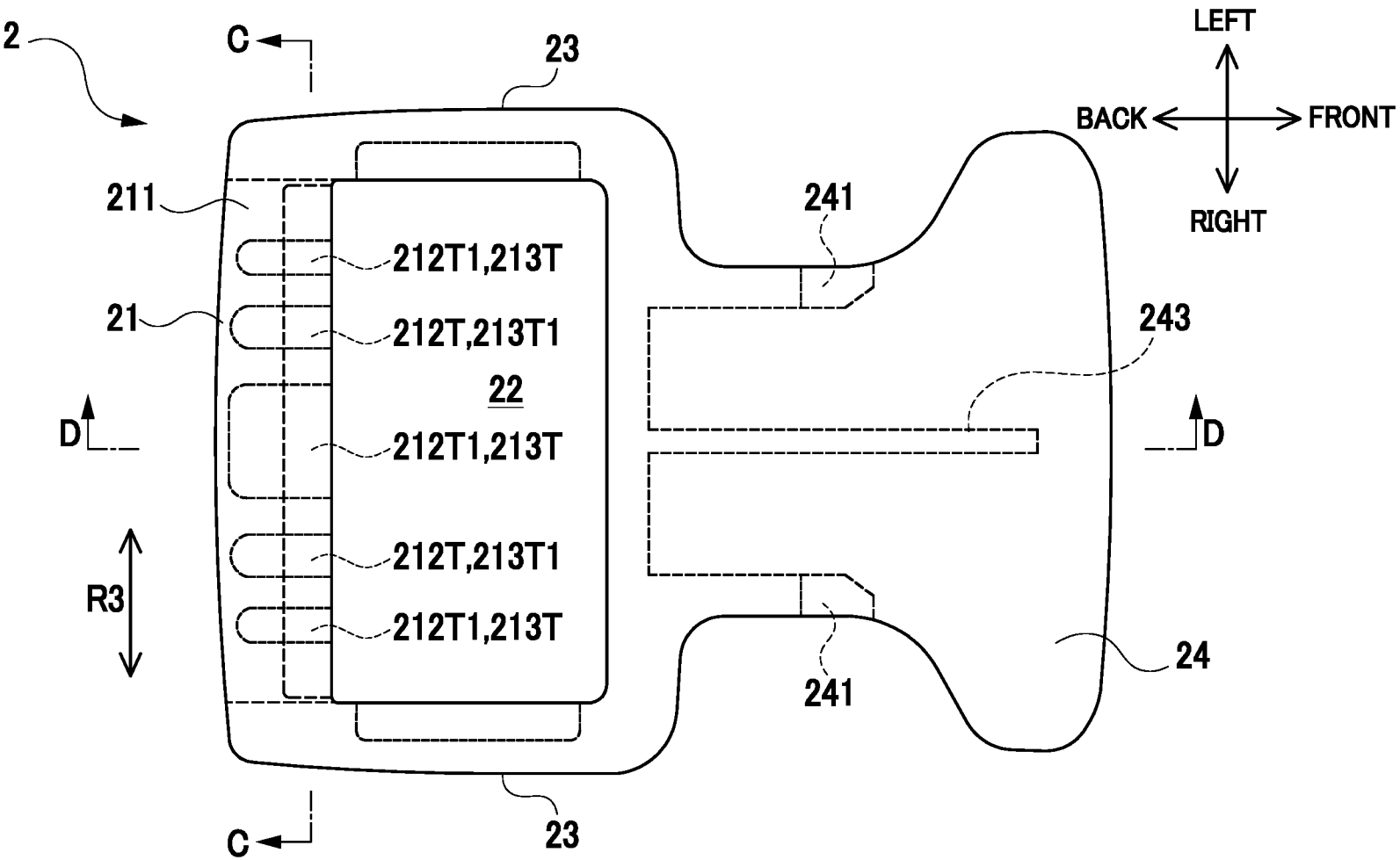
FIG. 5 is a plan view of a device body of the belt adjusting and holding device shown in FIG. 1.
Figure 6:
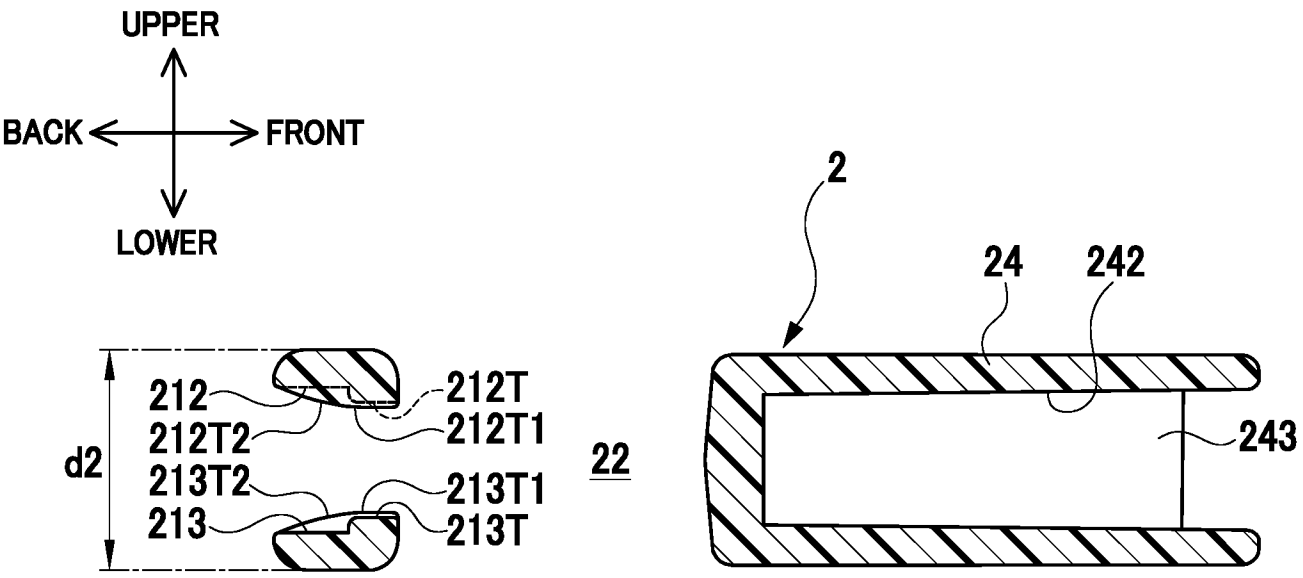
FIG. 6 is a cross-sectional view along D-D in FIG. 5.
Figure 7:
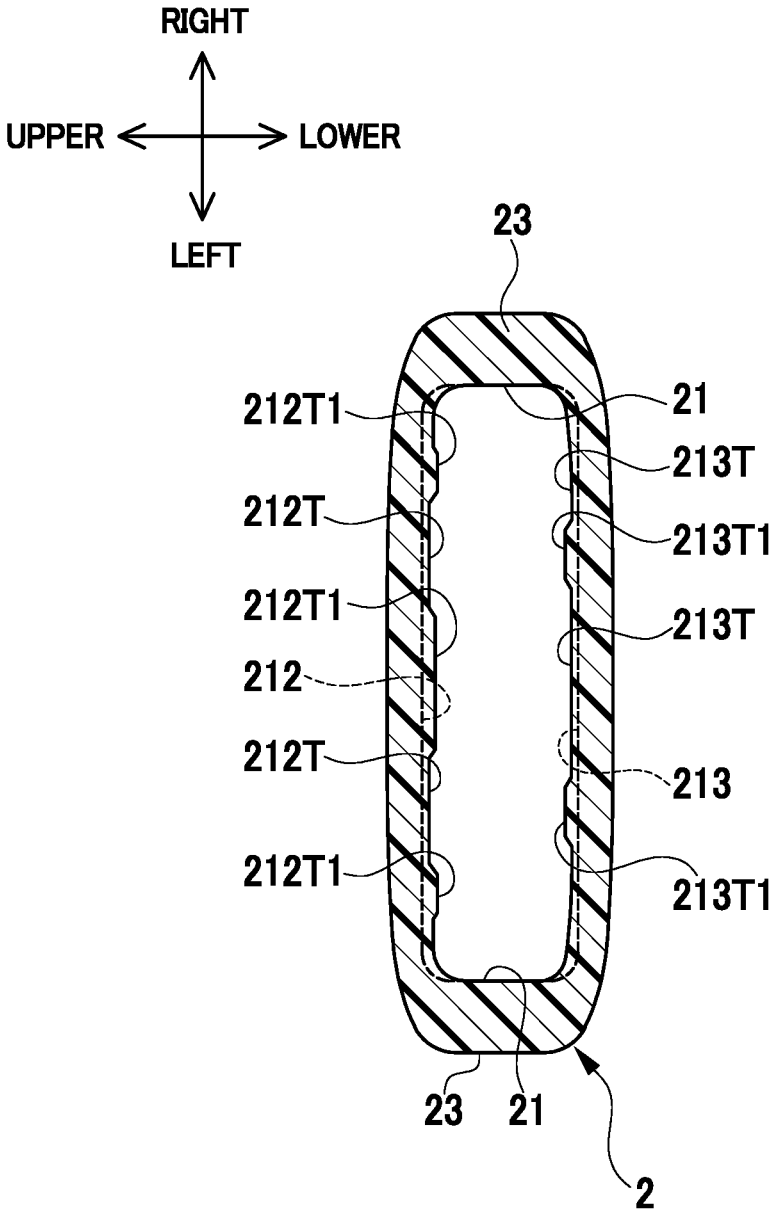
FIG. 7 is a cross-sectional view along C-C in FIG. 5.
Figure 8:
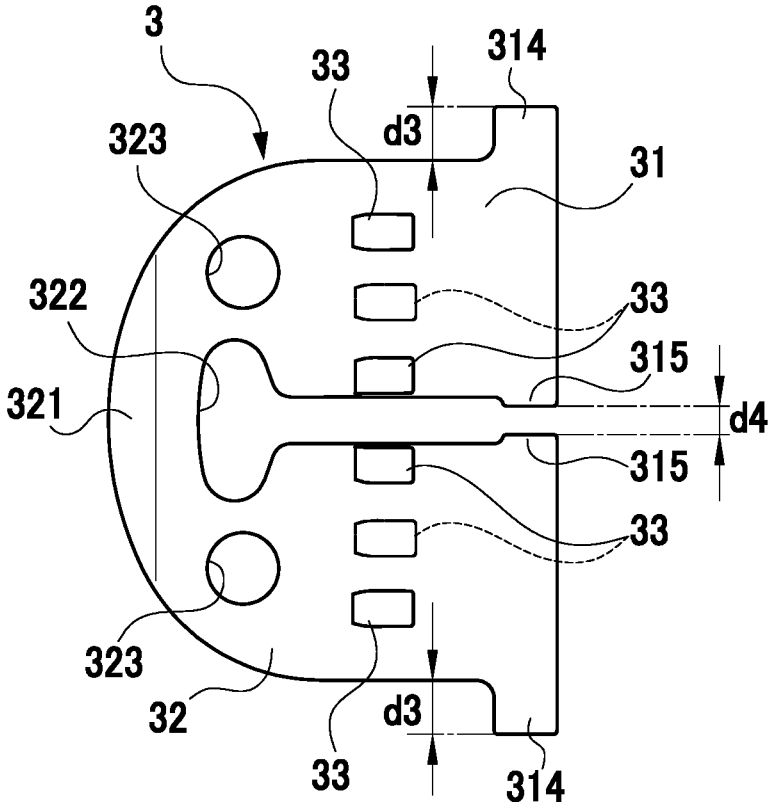
FIG. 8 is a plan view of a belt folding-back member of the belt adjusting and holding device shown in FIG. 1.
Figure 9:
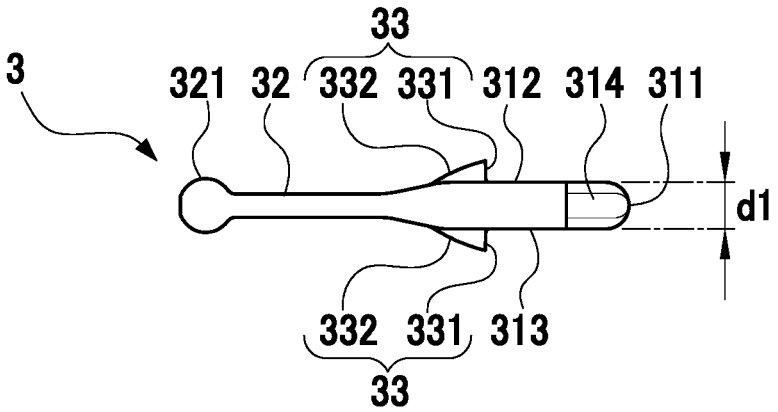
FIG. 9 is a front view of the belt folding-back member shown in FIG. 8.
Figure 10A:
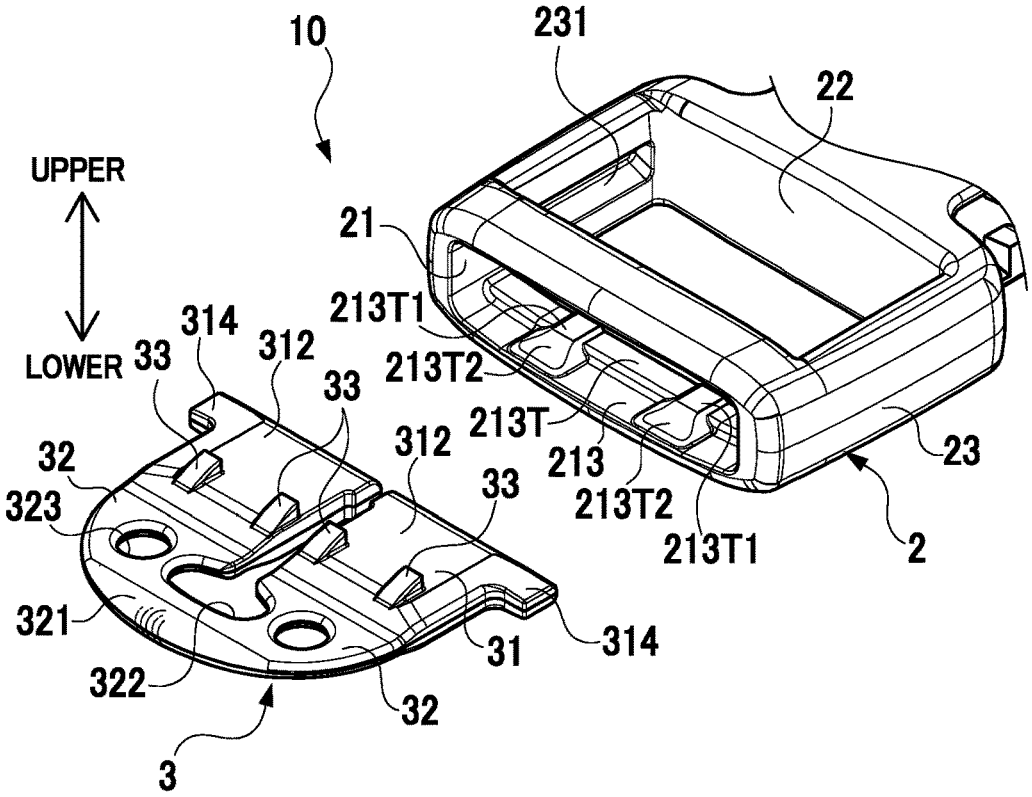
FIG. 10A is a perspective view of the device body and the belt folding-back member of the belt adjusting and holding device shown in FIG. 1, seen from an obliquely back upper side.
Figure 10B:
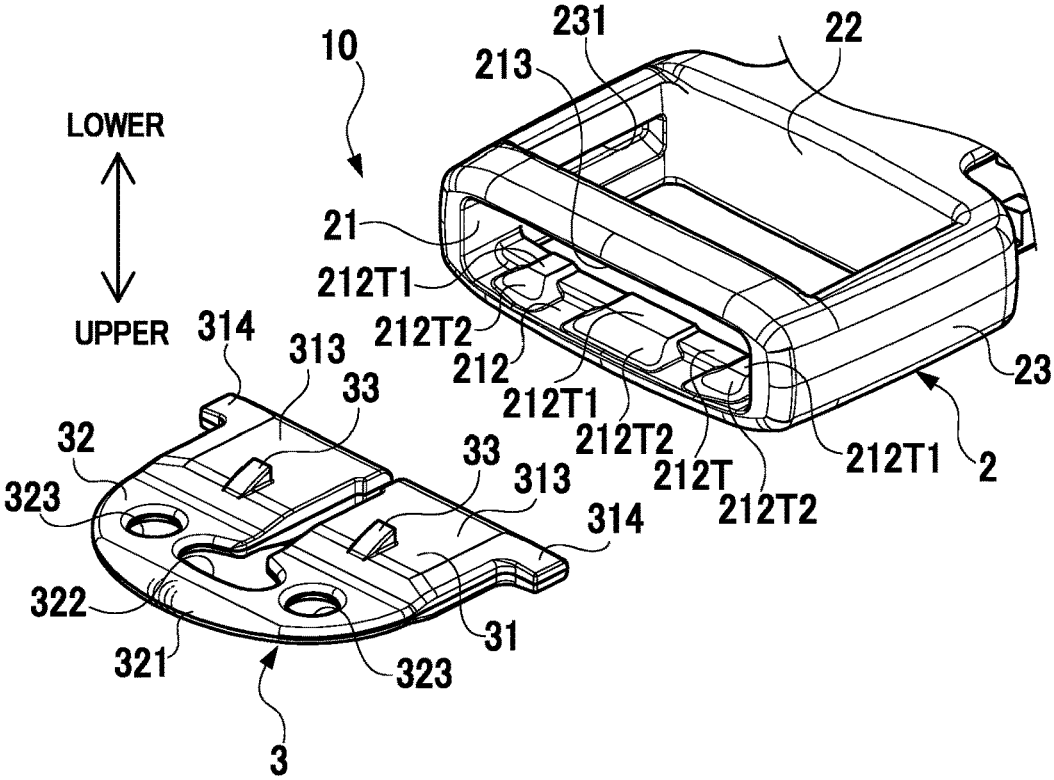
FIG. 10B is a perspective view of the device body and the belt folding-back member of the belt adjusting and holding device shown in FIG. 1, seen from an obliquely back lower side.
Figure 11A:
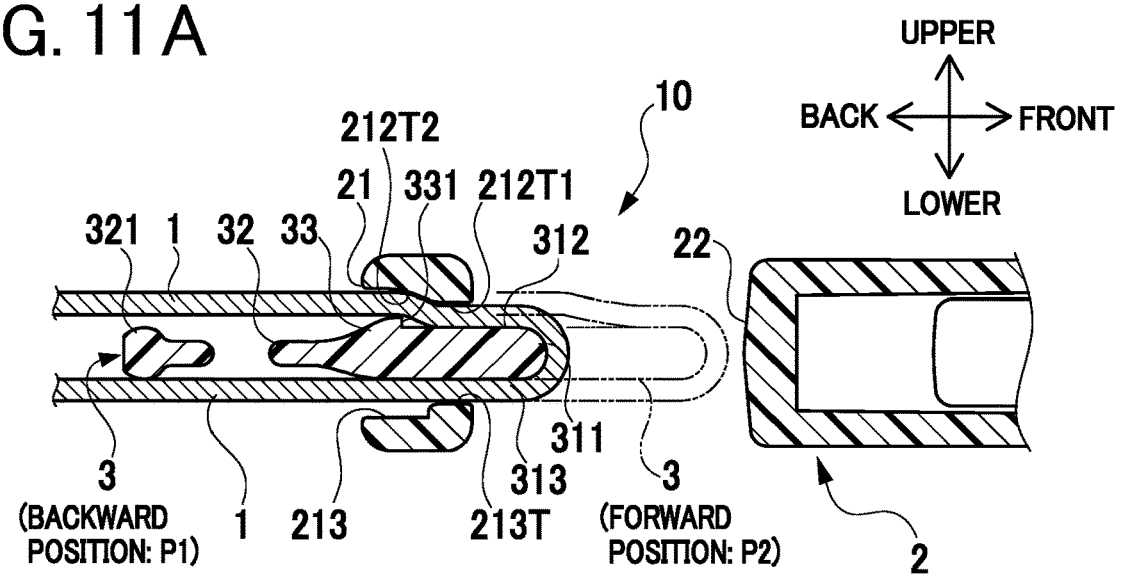
FIG. 11A is a cross-sectional view along E-E in FIG. 2.
Figure 11B:
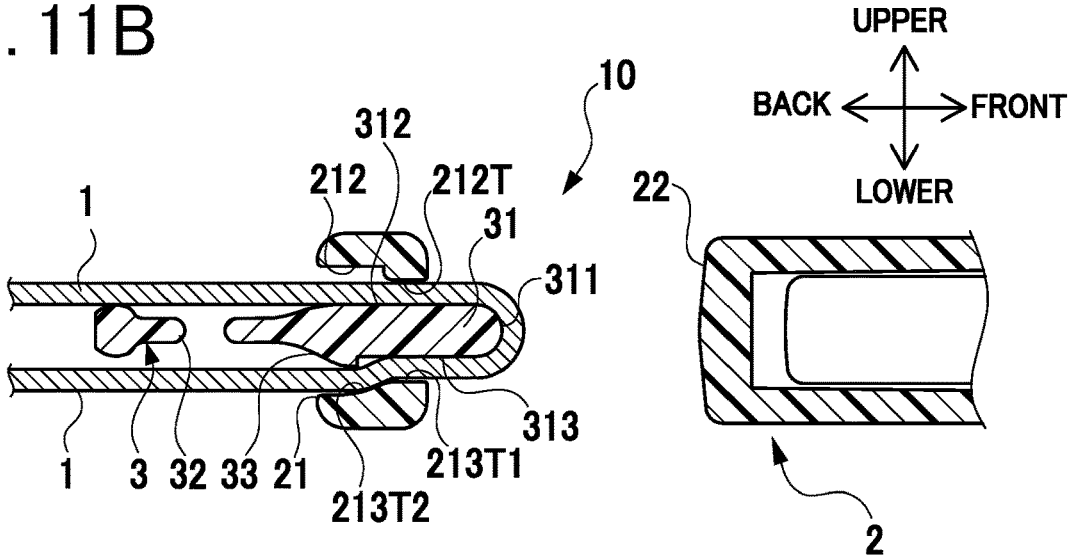
FIG. 11B is a cross-sectional view along F-F in FIG. 2.
Figure 11C:
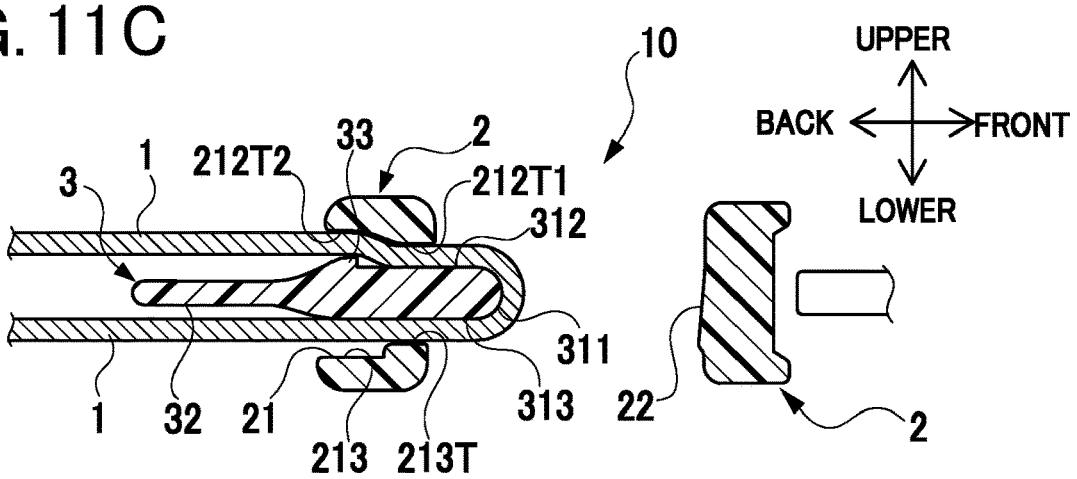
FIG. 11C is a cross-sectional view along G-G in FIG. 2.
Figure 12:
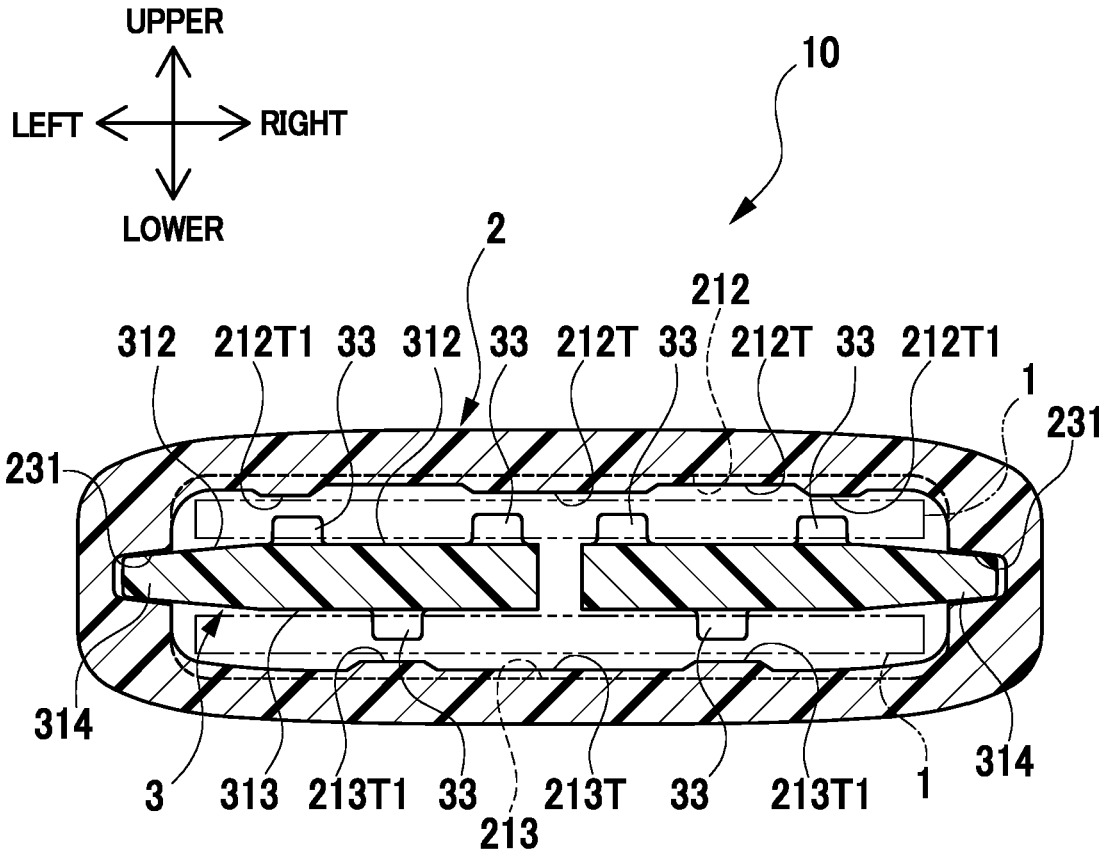
FIG. 12 is a cross-sectional view along H-H in FIG. 2.
Figure 13A:
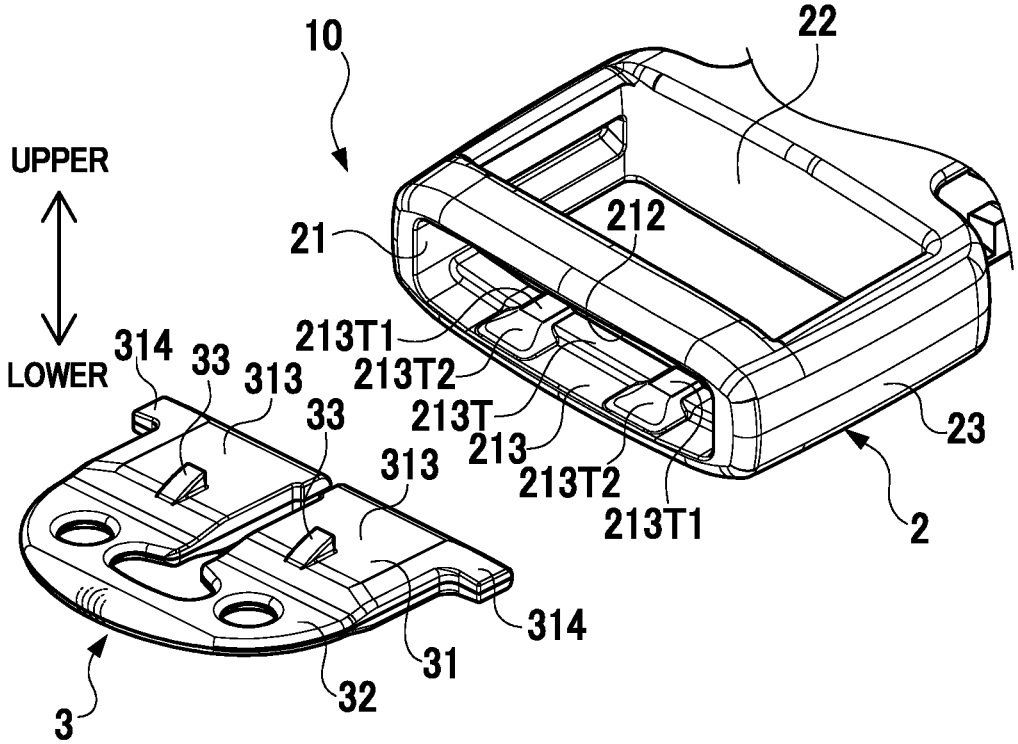
FIG. 13A is a perspective view of the device body and the belt folding-back member of the belt adjusting and holding device shown in FIG. 1, with the belt folding-back member turned upside down, seen from an obliquely back upper side.
Figure 13B:
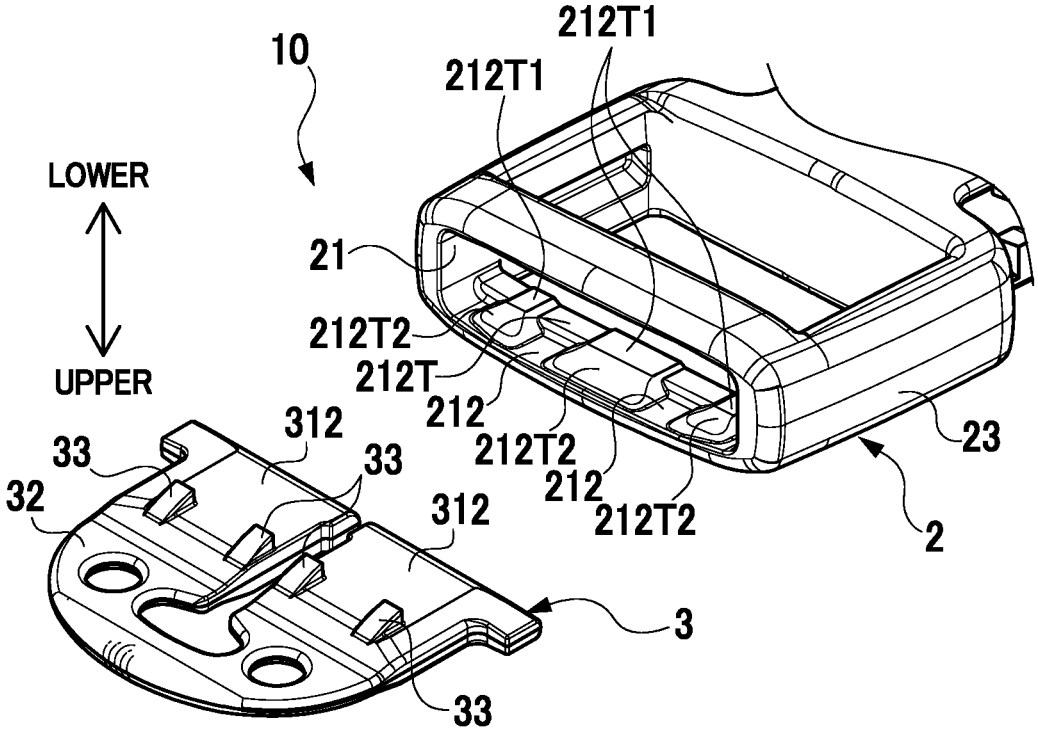
FIG. 13B is a perspective view of the device body and the belt folding-back member of the belt adjusting and holding device shown in FIG. 1, with the belt folding-back member turned upside down, seen from an obliquely back lower side.
Figure 14A:
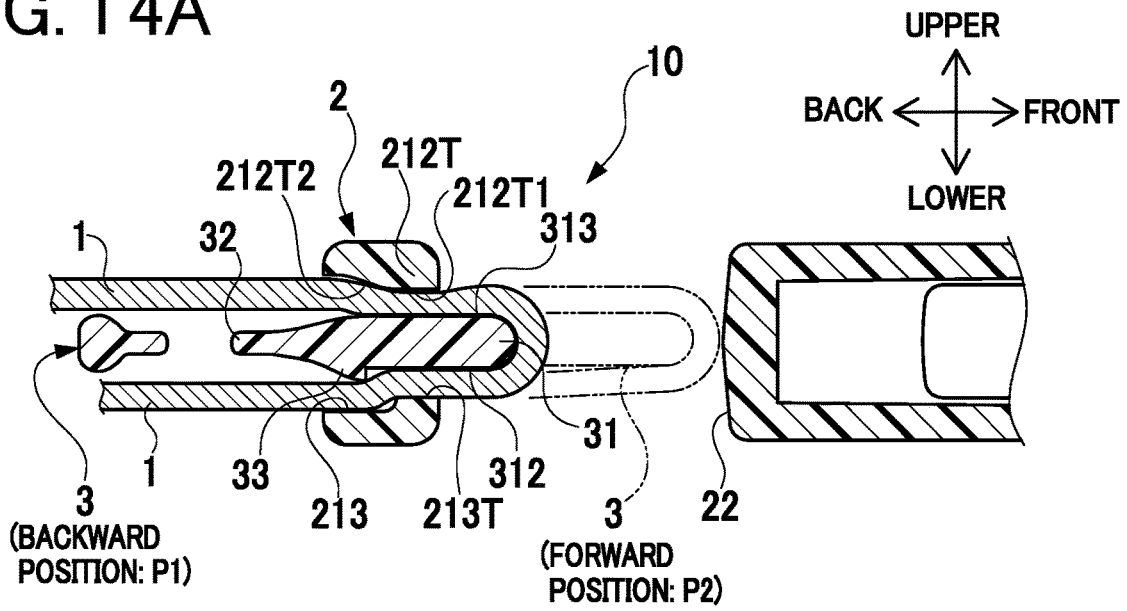
FIG. 14A is an E-E cross-sectional view of the belt adjusting and holding device shown in FIG. 2, with the belt folding-back member turned upside down.
Figure 14B:
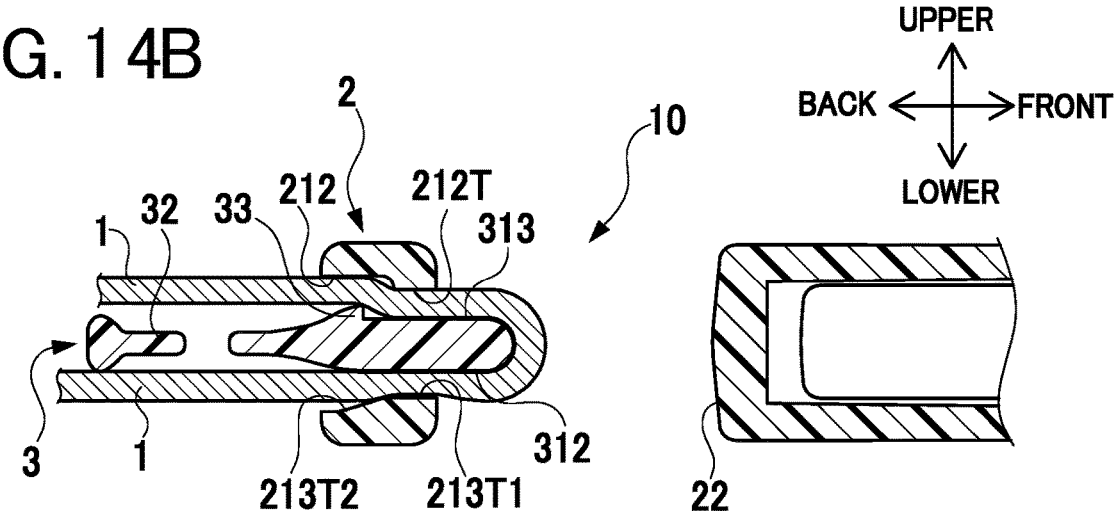
FIG. 14B is an F-F cross-sectional view of the belt adjusting and holding device shown in FIG. 2, with the belt folding-back member turned upside down.
Figure 14C:
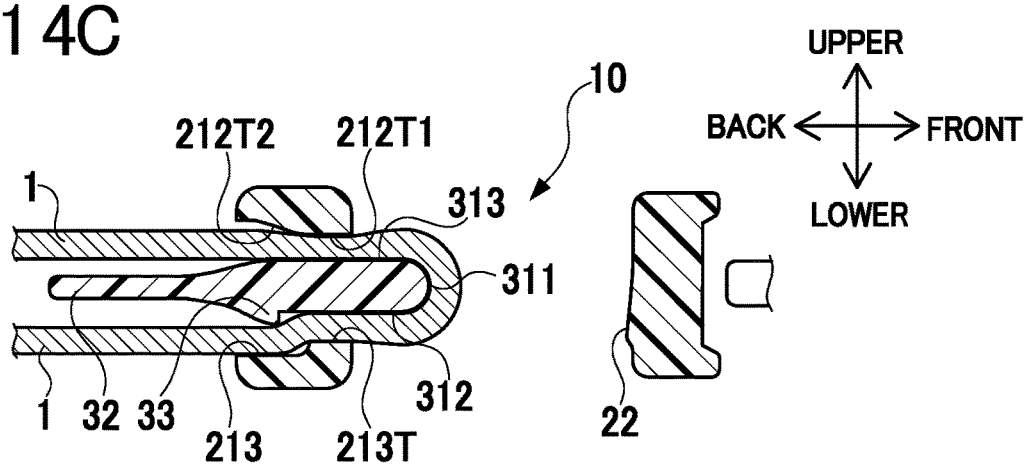
FIG. 14C is a G-G cross-sectional view of the belt adjusting and holding device shown in FIG. 2, with the belt folding-back member turned upside down.
Figure 15:
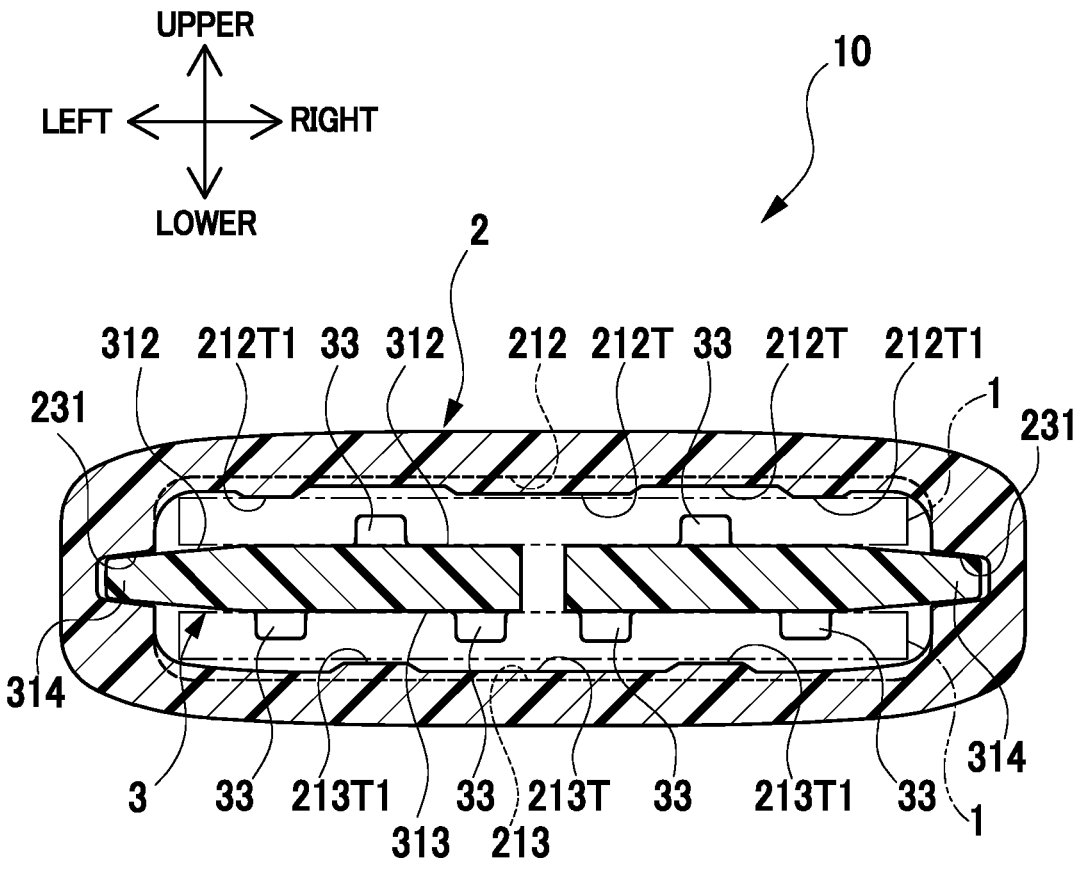
FIG. 15 is an H-H cross-sectional view of the belt adjusting and holding device shown in FIG. 2, with the belt folding-back member 3 turned upside down.

The belt adjusting and holding device in the first example of the present embodiment will be described first, referring to FIGS. 1 to 5. FIG. 1 is a perspective view of a belt adjusting and holding device in an exploded state in the first example of the present embodiment. FIG. 2 is a plan view of the belt adjusting and holding device shown in FIG. 1, in an assembled state, i.e., a belt-locking state. FIG. 3 is a view of the belt adjusting and holding device seen as indicated by an arrow A in FIG. 2. FIG. 4 is a cross-sectional view along B-B in FIG. 3. FIG. 5 is a plan view of a device body of the belt adjusting and holding device shown in FIG. 1. FIG. 6 is a cross-sectional view along D-D in FIG. 5. FIG. 7 is a cross-sectional view along C-C in FIG. 5. FIG. 8 is a plan view of a belt folding-back member of the belt adjusting and holding device shown in FIG. 1. FIG. 9 is a front view of the belt folding-back member shown in FIG. 8. FIG. 10 is a perspective view of the device body and the belt folding-back member of the belt adjusting and holding device shown in FIG. 1; specifically, FIG. 10A is a perspective view of the device body and the belt folding-back member of the belt adjusting and holding device shown in FIG. 1, seen from an obliquely back upper side; and FIG. 10B is a perspective view of the device body and the belt folding-back member of the belt adjusting and holding device shown in FIG. 1, seen from an obliquely back lower side. FIG. 11A is a cross-sectional view along E-E in FIG. 2. FIG. 11B is a cross-sectional view along F-F in FIG. 2. FIG. 11C is a cross-sectional view along G-G in FIG. 2. FIG. 12 is a cross-sectional view along H-H in FIG. 2. FIG. 13A is a perspective view of the device body and the belt folding-back member of the belt adjusting and holding device shown in FIG. 1, with the belt folding-back member turned upside down, seen from an obliquely back upper side. FIG. 13B is a perspective view of the device body and the belt folding-back member of the belt adjusting and holding device shown in FIG. 1, with the belt folding-back member turned upside down, seen from an obliquely back lower side. FIG. 14A is an E-E cross-sectional view of the belt adjusting and holding device shown in FIG. 2, with the belt folding-back member turned upside down. FIG. 14B is an F-F cross-sectional view of the belt adjusting and holding device shown in FIG. 2, with the belt folding-back member turned upside down. FIG. 14C is a G-G cross-sectional view of the belt adjusting and holding device shown in FIG. 2, with the belt folding-back member turned upside down. FIG. 15 is an H-H cross-sectional view of the belt adjusting and holding device shown in FIG. 2, with the belt folding-back member turned upside down.

(Configurations of the Belt Adjusting and Holding Device)

As shown in FIGS. 1 to 15, a belt adjusting and holding device 10 in the first example of the present embodiment is configured to adjust the length of at least one belt 1 and hold the adjusted belt 1, and includes a device body 2, and a belt folding-back member 3 having a substantially plate shape configured to move forward and backward in a front-back direction R1 within the device body 2. These device body 2 and belt folding-back member 3 can be made of thermoplastic resin by injection molding. The belt 1 may be applied to various types of belts or straps, made of resin, synthetic fibers, leather, or natural fibers.

Here, the device body 2 includes a belt insertion part 21 formed in a back end portion 211 and opening in a substantially rectangular shape to allow the belt 1 to be inserted forward, and an opening section 22 having a substantially rectangular shape, communicating with the belt insertion part 21, and extending through in an upper-lower direction R2 perpendicular to the insertion direction of the belt 1. In this example, the opening section 22 is formed penetrating through the device body 2, opening at an upper end and a lower end of the device body 2, but a part or the entire area of either the upper end or the lower end may be closed. The belt folding-back member 3 includes a folding-back part 31 configured to allow the belt 1 to wind around a front end 311 and turn back toward the rear side, i.e., fold backward, within the opening section 22 of the device body 2, and a grasping part 32 located on a back end side of the folding-back part 31 and configured to project backward from the belt insertion part 21 together with the folded belt 1.

Further, the belt insertion part 21 includes an upper inner wall surface 212 and a lower inner wall surface 213 which are respectively formed with a standing wall portion 212T and a standing wall portion 213T, each rising inward in a stepped shape on the side near the opening section 22 and extending almost continuously in a belt width direction R3 between right and left sidewalls 23. Here, the standing wall portion 212T standing on the upper inner wall surface 212 and the standing all 213T standing on the lower inner wall surface 213 are vertically protrude with almost the same height and almost the same width in the front-back direction. The standing wall portion 212T and the standing wall portion 213T are respectively formed extending almost the same the width of the upper inner wall surface 212 and the lower inner wall surface 213 in the front-back direction. Further, the lower end face of the standing wall portion 212T is almost parallel to the upper inner wall surface 212, and the upper end face of the standing wall portion 213T is almost parallel to the lower inner wall surface 213. Accordingly, the standing wall portions 212T and 213T are respectively formed in a stepped shape protruding inward from the upper inner wall surface 212 and the lower inner wall surface 213. Here, the standing wall portions 212T and 213T each continuously extend in the belt width direction R3, but may be partly separated as long as they are almost continuous.

The folding-back part 31 includes an upper end face 312 and a lower end face 313, at least one of which is formed with protrusions 33, which are disposed near back of the standing wall portion 212T or 213T when the belt folding-back member 3 is moved to the backward position P1, bending the belt 1 into a substantially stepped shape between the protrusions 33 and the standing wall portions 212T and 213T, and which are disposed in the opening section 22 when the belt folding-back member 3 is moved to the forward position P2, releasing the belt 1 from bending. In this example, a plurality of protrusions 33 is formed with predetermined different widths on the upper end face 312 and the lower end face 313 of the folding-back part 31. However, the protrusion or protrusions 33 may be formed either the upper end face 312 or the lower end face 313. The protrusions 33 each have a shape that is highest at a front end and gradually lower toward a back end.

In the belt adjusting and holding device 10 in the first example configured as above, when fixing the belt 1 to the device body 2, the belt folding-back member 3 is moved together with the folded belt 1 to the backward position P1, thereby bending the belt 1 into a substantially stepped shape between the standing wall portions 212T and 213T and the projections 33, so that the belt 1 is prevented from moving by its deformation resistance. The belt folding-back member 3 is not allowed to move backward more than the backward position P1 relative to the device body 2. Thus, even if the belt 1 is pulled strongly, the belt 1 does not move with respect to the device body 2. Therefore, by simply moving the belt folding-back member 3 together with the folded belt 1 to the backward position P1, the belt 1 can be easily fixed to the device body 2.

In order to adjust the length of the belt 1 with respect to the device body 2, it is only necessary to move the belt folding-back member 3 together with the folded belt 1 to the forward position P2. Specifically, when the belt folding-back member 3 is moved to the forward position P2, the protrusions 33 of the folding-back part 31 are moved into the opening section 22, and therefore the belt 1 wound around the folding-back part 31 of the belt folding-back member 3 moved to the forward position P2 is released from restraint between the protrusions 33 and the standing wall portion 212T or 213T, so that the belt 1 is allowed to freely move within the opening section 22. Thus, the length of the belt 1 can be easily adjusted with respect to the device body 2 by simply moving the belt folding-back member 3 together with the folded belt 1 to the forward position P2.

While the belt folding-back member 3, which has been moved together with the folded belt 1, is disposed at the backward position P1, the belt 1 is bent in a substantially stepped shape between the standing wall portions 212T and 213T and the protrusions 33. To move this belt folding-back member 3 from the backward position P1 to the forward position P2, it is necessary to apply a force to cause the protrusions 33 to pass over the standing wall portions 212T and 213T together with the bent belt 1. The belt folding-back member 3 is therefore locked at the backward position P1 through the bent belt 1. Accordingly, even when the belt 1 is not in use, the belt 1 is not displaced with respect to the device body 2, thus eliminating the need for readjustment of the belt adjusting and holding device 10 each time the belt 1 is used.

Since the device body 2 includes the belt insertion part 21 formed in the back end portion 211 and opening in a substantially rectangular shape to allow the belt 1 to be inserted forward and the substantially rectangular opening section 22 communicating with the belt insertion part 21 and extending in the upper-lower direction R2 perpendicular to the insertion direction of the belt 1, and the belt folding-back member 3 has a substantially plate shape and is configured to move forward and backward in the front-back direction R1 within the device body 2, and the belt folding-back member 3 includes the folding-back part 31 configured to allow the belt 1 to wind around the front end 311 and fold backward within the opening section 22, and the grasping part 32 located on the back end side of the folding-back part 31 and configured to project backward from the belt insertion part 21 together with the folded belt 1, when the folding-back part 31 of the belt folding-back member 3 has the thickness d1 in the upper-lower direction R2 set to a minimum thickness needed for folding back the belt 1, the thickness d2 of the device can be easily prevented from becoming excessive.

Therefore, the belt adjusting and holding device 10 in the first example can be provided without an excessive device thickness and capable of easily adjusting the length of the belt 1 and holding the adjusted belt 1, thus eliminating the need for readjustment at each use.

In the belt adjusting and holding device 10 in the first example, as shown in FIG. 9, preferably, the upper end face 312 and the lower end face 313 of the folding-back part 31 are parallel to each other, the protrusions 33 each include a front wall surface 331 facing forward and vertically extending from the upper end face 312 or the lower end face 313 and a rear inclined surface 332 inclined obliquely forward at an acute angle relative to the upper end face 312 or the lower end face 313.

In this case, when the belt folding-back member 3 is moved from the forward position P2 to the backward position P1, the rear inclined surfaces 332 of the protrusions 33 press against the standing wall portions 212T and 213T, thereby resiliently warping the upper inner wall surface 212 and the lower inner wall surface 213 of the belt insertion part 21, so that a gap between these inner wall surfaces is easily expanded. This can reduce the force needed to move the belt folding-back member 3 from the forward position P2 to the backward position P1 and thus the belt 1 can be fixed to the device body 2 with less operating force. The gap between the upper end face 312 or the lower end face 313 of the folding-back part 31 and the standing wall portion 212T or 213T is preferably formed equal to or slightly larger than the thickness of the belt 1. In this case, it is possible to reduce the frictional force occurring between the belt 1 in contact with the upper end face 312 or the lower end face 313 of the folding-back part 31 and the standing wall portion 212T or 213T when the belt folding-back member 3 is moved together with the folded belt 1 to the backward position P1 or the forward position P2. Thus, the handleability is further improved.

On the other hand, each protrusion 33 includes the front wall surface 331 facing forward and vertically extending from the upper end face 312 or the lower end face 313 of the folding-back part 31. Thus, when the belt folding-back member 3 is moved together with the folded belt 1 to the backward position P1, the belt 1 can be bent at an angle near a right angle between the standing wall portion 212T and 213T and the front wall surfaces 331 of the protrusions 33, thus increasing the deformation resistance of the belt 1. Therefore, when the belt folding-back member 3 is moved to the backward position P1, the belt 1 can be firmly fixed to the device body 2 with a crisp feel.

In the belt adjusting and holding device 10 in the first example, as shown in FIGS. 2, and 10A to 15, preferably, the protrusions 33 are provided on the upper end face 312 and the lower end face 313 of the folding-back part 31, at different positions between the upper and lower end faces in the belt width direction R3. The standing wall portion 212T formed on the upper inner wall surface 212 of the belt insertion part 21 is formed with first raised portions 212T1 protruding inward at the positions facing the protrusions 33 formed on the upper end face 312 of the folding-back part 31. The standing wall portion 213T formed on the lower inner wall surface 213 of the belt insertion part 21 is formed with second raised portions 213T1 protruding inward at the positions facing the protrusions 33 formed on the lower end face 313 of the folding-back part 31. The belt folding-back member 3 is configured to move, even in an upside-down state, forward and backward in the front-back direction R1 within the device body 2.

In this example, the protrusions 33 each have a predetermined width and are spaced at intervals wider than the predetermined width of each protrusion 33 and arranged in series in the belt width direction R3. A plurality of the protrusions (e.g., four protrusions) 33 are formed on the upper end face 312 of the folding-back part 31 and a plurality of the protrusions (e.g., two protrusions) 33 are formed on the lower end face 313 of the folding-back part 31. For the standing wall portion 212T formed on the upper inner wall surface 212 of the belt insertion part 21, one of the first raised portions 212T1 is formed with a wide width to face over two protrusions 33 located near the center, and the remaining first raised portions 212T1 are formed with almost the same width as each protrusion 33 to face in one-to-one relation to the protrusions 33 located at both ends. Further, for the standing wall portion 213T formed on the lower inner wall surface 213 of the belt insertion part 21, two second raised portions 213T1 are formed with almost the same width as each protrusion 33 to individually face two protrusions 33 formed on the lower end face 313 of the folding-back part 31.

In this case, while the belt folding-back member 3 not turned upside down is disposed together with the folded belt 1 at the backward position P1, as shown in FIGS. 11 and 12, the gaps between the first raised portions 212T1 and the upper end face 312 of the folding-back part 31 at the positions where the first raised portions 212T1 face the corresponding protrusions 33 are narrowed just by the height of the first raised portions 212T1, and further the gaps between the second raised portions 213T1 and the lower end face 313 of the folding-back part 31 at the positions where the second raised portions 213T1 face the corresponding protrusions 33 are narrowed just by the height of the second raised portions 213T1. Therefore, even the belt 1 having a relatively thinner thickness than the gap between the standing wall portions 212T and 213T and the folding-back part 31 can be bent into a substantially stepped shape between the protrusions 33 of the folding-back part 31 and the first raised portions 212T1 and the second raised portions 213T1 of the belt insertion part 21. Thus, even the thin belt 1 can be firmly fixed to the device body 2.

In contrast, when the belt folding-back member 3 is turned upside down with respect to the device body 2, as shown in FIGS. 13A to 15, the protrusions 33 of the folding-back part 31 are arranged at different positions in the belt width direction R3 with respect to the first raised portions 212T1 and the second raised portions 213T1 of the belt insertion part 21. Thus, while the upside-down belt folding-back member 3, which has been moved together with the folded belt 1, is disposed at the backward position P1, this belt 1 is bent in a substantially stepped shape between the standing wall portions 212T and 213T and the protrusions 33 without being influenced by the first raised portions 212T1 and the second raised portions 213T1, so that the belt 1 is prevented from moving by its deformation resistance. When the upside-down belt folding-back member 3 is moved to the backward position P1, the belt folding-back member 3 can more firmly fix a thick belt 1 to the device body 2 as compared with the belt folding-back member 3 not turned upside down. As a result, a single belt adjusting and holding device 10 can adjust the length of different belts 1 of different thicknesses and hold the adjusted belt 1 by simple operation of turning the belt folding-back member 3 upside down and attaching it to the device body 2.

In the belt adjusting and holding device 10 in the first example, preferably, as shown in FIGS. 10A to 15, the first raised portions 212T1 are each formed, on the back end side, with a first inclined surface 212T2 inclined back-upward toward the upper inner wall surface 212 of the belt insertion part 21, and the second raised portions 213T1 are each formed, on the back end side, with a second inclined surface 213T2 inclined back-downward toward the lower inner wall surface 213 of the belt insertion part 21.

In this case, for example, when the belt folding-back member 3 not turned upside down is moved from the backward position P1 to the forward position P2, the belt 1 bent by the protrusions 33 formed on the upper end face 312 of the folding-back part 31 presses upward the first raised portions 212T1 through the first inclined surfaces 212T2, while the belt 1 bent by the protrusions 33 formed on the lower end face 313 of the folding-back part 31 presses downward the second raised portions 213T1 through the second inclined surfaces 213T2, resiliently warping the upper inner wall surface 212 and the lower inner wall surface 213 of the belt insertion part 21 to easily expands the gap between these inner wall surfaces. This can reduce the force needed to move the belt folding-back member 3 from the forward position P2 to the backward position P1 and thus the length of the belt 1 can be adjusted with respect to the device body 2 with less operating force.

The belt adjusting and holding device 10 in the first example is preferably configured below. Specifically, as shown in FIGS. 1 to 4, 8, and 9, the right and left sidewalls 23 of the device body 2 are each formed with a guide groove 231 extending in the front-back direction R1 to guide movement of the belt folding-back member 3 between the forward position P2 and the backward position P1. The folding-back part 31 is formed, at right and left outer edges, with guide projections 314 which engage with the guide grooves 231. Further, the folding-back part 31 includes right and left portions separated at the center in the belt width direction R3 and joined to each other in a nearly U shape through the grasping part 32. In this example, the grasping part 32 includes a back end 321 having a nearly circular-arc shape in plan view, and the back end 321 has a thicker thickness than a joined portion with the folding-back part 31 and has a nearly circular-arc cross-section. The grasping part 32 is further formed with a nearly-elliptical cutout 322 and circular holes 323 to facilitate engagement of the guide projections 314 of the separated right and left portions of the folding-back part 31 into the guide grooves 231. Further, each guide groove 231 has a tapered cross-section with a groove width increasing toward the inside of the opening section 22.

In this case, by vertically displacing the separated right and left portions of the folding-back part 31 and overlapping their central portions one on the other to engage the guide projections 314 of the folding-back part 31 into the guide grooves 231 of the sidewalls 23 of the device body 2, the belt folding-back member 3 can be easily attached to the device body 2. Furthermore, by moving the guide projections 314 to the front ends of the guide grooves 231, the belt folding-back member 3 can be moved to the forward position P2, thus easily adjusting the length of the belt 1. In contrast, by moving the guide projections 314 to the back ends of the guide grooves 231, the belt folding-back member 3 can be moved to the backward position P1, thereby easily fixing the belt 1 to the device body 2. This configuration enables to easily attach the belt folding-back member 3 to the device body 2, easily adjust the length of the belt 1, and fix the adjusted belt 1 to the device body 2.

As shown in FIGS. 4 and 8, preferably, the folding-back part 31 is formed, on the center side of the right and left separated portions, with a pair of contact portions 315 facing each other with a predetermined gap d4. The guide projections 314 engaged in the guide grooves 231 are pressed from right and left by the guide grooves 231, resiliently warping the grasping part 32, reducing the gap d4 between the contact portions 315 to a gap d5 smaller than the gap d4 defined before engagement. The gap d5 is set smaller than a projecting amount or length d3 of each guide projection 314 from the right/left outer side end of the folding-back part 31.

In this case, the guide projections 314 of the folding-back part 31 are configured to unlikely come off the guide grooves 231 by the resilient force of the grasping part 32. Even when the belt 1 is strongly pulled, the right and left contact portions 315 contact with and push against each other, thereby keeping the guide projections 314 engaged in the guide grooves 231. Accordingly, while the belt folding-back member 3, which has been moved to the backward position P1, clamps the belt 1 to the device body 2, the belt folding-back member 3 can avoid from falling off from the device body 2, and hence reliably fix the belt 1 to the device body 2.

Each of the guide grooves 231 may be formed extending through the corresponding sidewall 23 from the inside of the opening section 22 to the outside of the sidewall 23 in parallel to the belt width direction R3. Even in this case, the proximal ends of the guide projections 314 of the folding-back part 31 contact the inner peripheral portions of the guide grooves 231, for example, so that the guide projections 314 and the guide grooves 231 can be maintained in engaged relation.

As shown in FIGS. 1 to 6, preferably, the belt adjusting and holding device 10 in the first example is provided with a striker 4 including a proximal end portion 41 to which a belt 1K for length fixation is fixed and a distal end portion 42 formed with locking pawls 421. The device body 2 includes, on the front end side of the opening section 22, a striker housing part 24 configured to detachably hold the striker 4, and engaging protrusions 241 located in the striker housing part 24 and configured to engage with the locking pawls 421 of the striker 4.

In this example, the striker 4 is formed with a slot 411 between the proximal end portion 41 and the distal end portion 42. The belt 1K for length fixation is passed through the slot 411, wound around the proximal end portion 41, and fixed in place. The distal end portion 42 of the striker 4 is formed with separated right and left insertion leg portions 422 located on the center side and operating portions 423 located on the right and left outer sides of the insertion leg portions 422, the operating portions 423 including the locking pawls 421. Further, the striker housing part 24 includes a housing chamber 242 formed with a guide rib 243 for guiding the insertion leg portions 422 in the front-back direction R1 and engaging protrusions 241 configured to engage with the locking pawls 421 of the striker 4. The engaging protrusions 241 are formed separately on the upper inner wall and the lower inner wall of the housing chamber 242. When the distal end portion 42 of the striker 4 is inserted into the housing chamber 242, the operating portions 423 of the striker 4 pass between the separated upper and lower engaging protrusions 24 while being pressed and deformed by the engaging protrusions 241. When this insertion is completed, the locking pawls 421 engage with the engaging protrusions 241. In contrast, by pressing inward the right and left operating portions 423, the locking pawls 421 and the engaging protrusions 241 can be disengaged.

In this case, the belt 1 for length adjustment can be fixed with an adjustable length on the back end side of the device body 2 through the belt folding-back member 3, while the belt 1K for length fixation can be detachably connected to the device body 2 through the striker 4 in the striker housing part 24 formed on the front end side of the device body 2. Therefore, the belt folding-back member 3 and the striker 4 can be arranged adjacent to each other in the front-back direction R1 of the device body 2, without overlapping each other in the upper-lower direction R2. As a result, the device can be slimmed, thus resulting in an improved external appearance and an enhanced handleability and operability.

(Method for Operating the Belt Adjusting and Holding Device)

The method for operating the belt adjusting and holding device 10 in the first example will be described briefly. Specifically, the grasping part 32 of the belt folding-back member 3 is inserted into the device body 2 through the opening section 22, passed through the gap between the upper inner wall surface 212 and the lower inner wall surface 213 of the belt insertion part 21 so as to protrude out from the back end portion 211 of the belt insertion part 21. While the right and left separate parts of the folding-back part 31 are displaced vertically with their central portions overlapping one on the other within the opening section 22, the guide projections 314 are inserted into engagement with the guide grooves 231 formed in the sidewalls 23 of the device body 2. Then, the right and left separated portions of the folding-back part 31 are returned to each original state. Thus, the belt folding-back member 3 can be attached to the device body 2 so as to be movable forward and backward in the front-back direction R1. The belt folding-back member 3 is moved to the forward position P2 of the device body 2 and further the belt 1 for length adjustment is inserted from the belt insertion part 21 into the opening section 22 along the grasping part 32. In the opening section 22, the belt 1 is wound around the front end 311 of the folding-back part 31 and folded backward so that the folded part protrudes backward out of the belt insertion part 21.

Next, in order to adjust the length of the belt 1 for length adjustment with respect to the device body 2, the folded belt 1 and the grasping part 32 are grasped together, and the belt folding-back member 3 is moved to the forward position P2 of the device body 2, separating the belt 1 from the folding-back part 31 into a loosened state, and the belt 1 is moved forward and backward to adjust its length. Furthermore, in order to fix the belt 1 with the adjusted length to the device body 2, the folded belt 1 and the grasping part 32 are grasped together, and the belt folding-back member 3 is moved from the forward position P2 to the backward position P1, bending and restraining the belt 1 into a substantially stepped shape between the protrusions 33 of the belt folding-back member 3 and the standing wall portions 212T and 213T of the belt insertion part 21. In this example, since the back end 321 of the grasping part 32 has a nearly circular-arc cross-section, even when the grasping part 32 grasped together with the belt 1 is pulled by fingers to bend the belt 1 into a substantially stepped shape, the fingers that grasp the grasping part 32 feel less pain.

The belt folding-back member 3 is prevented from slipping out of the belt insertion part 21 by the guide projections 314 contacting the back ends of the guide grooves 231 at the backward position P1 of the device body 2. Further, while the belt folding-back member 3 is disposed at the backward position P1 of the device body 2, the belt folding-back member 3 is locked at the backward position P1 through the bent belt 1. Accordingly, even when the external force in the front-back direction somewhat acts on the belt folding-back member 3, the belt 1 can remain fixed.

<Belt Adjusting and Holding Device in Second Example>

Figure 16:
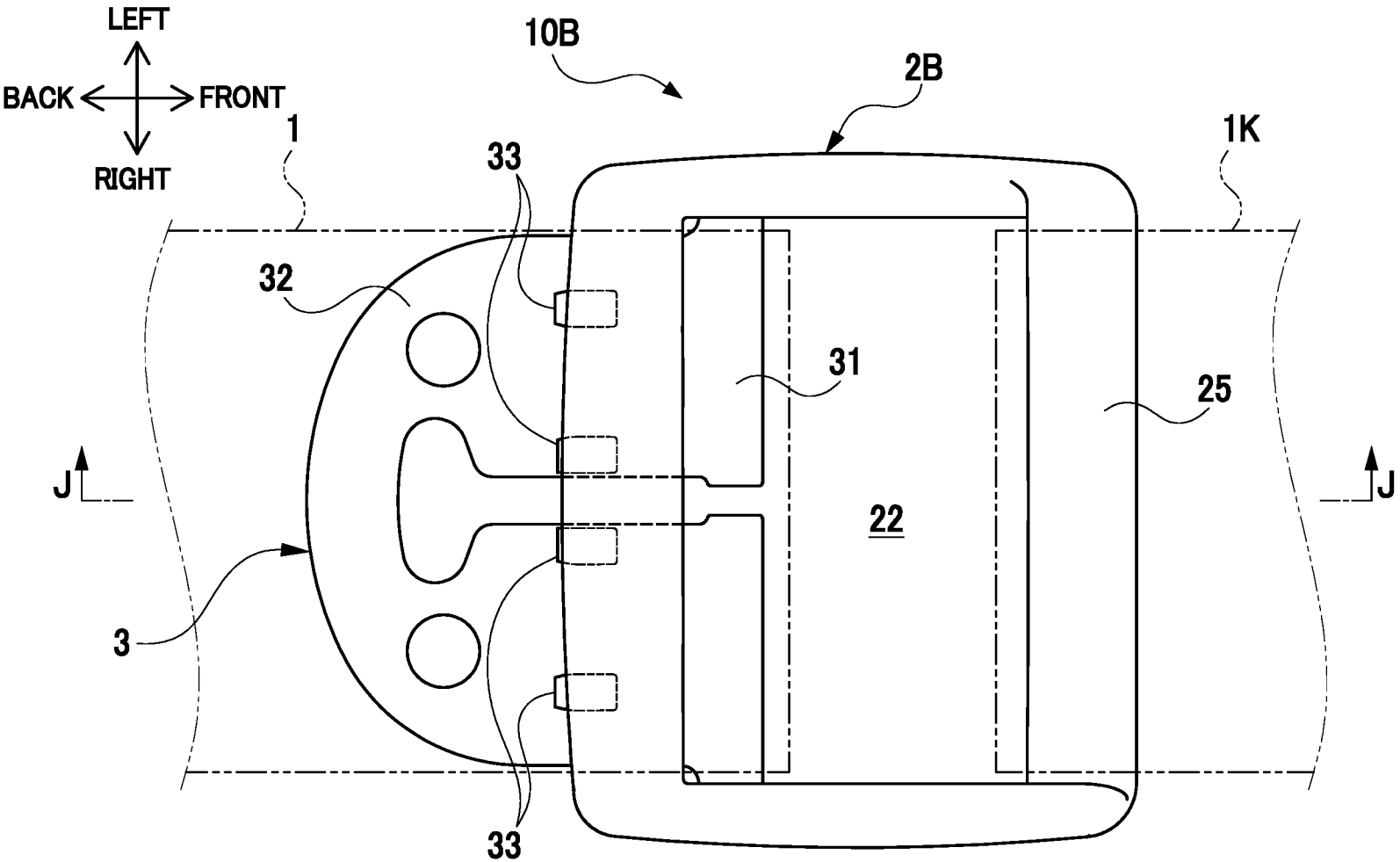
FIG. 16 is a plan view of a belt adjusting and holding device in an assembled state, i.e., a belt-locking state, in a second example of the embodiment.
Figure 17:
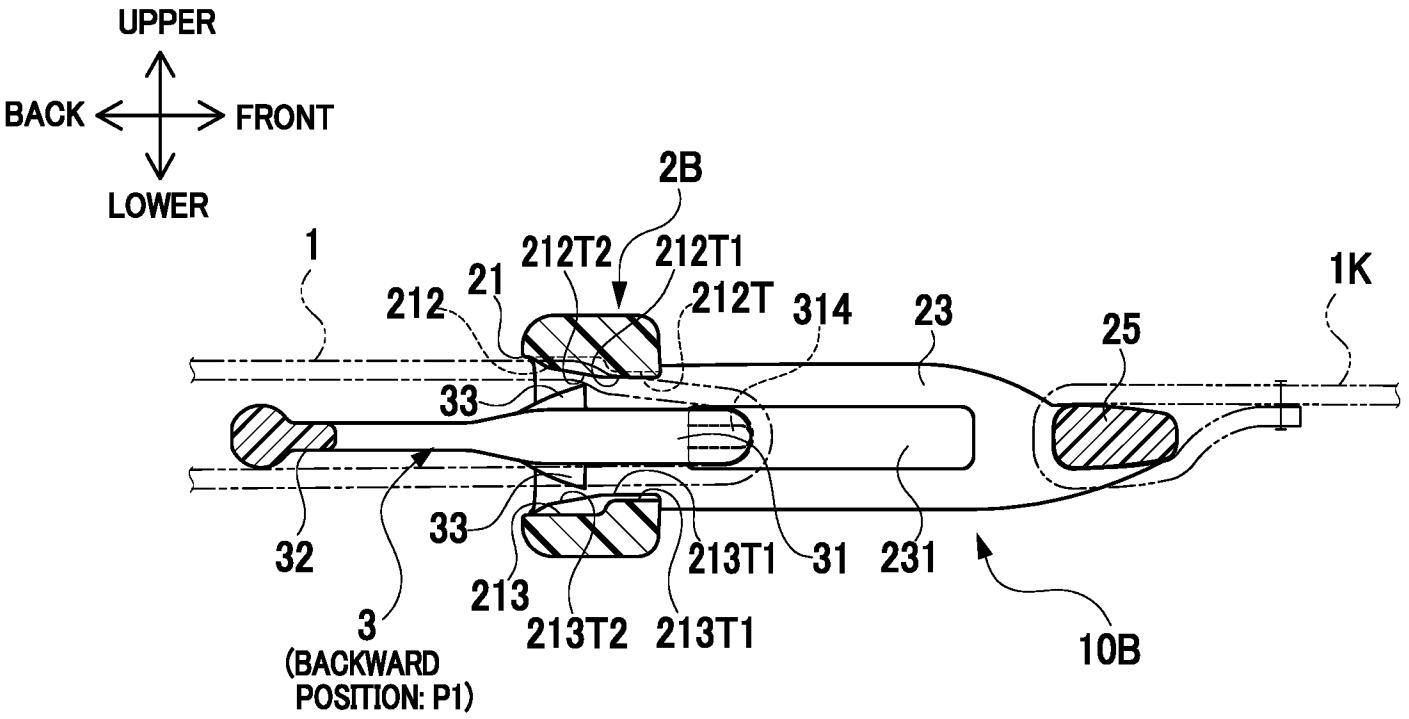
FIG. 17 is a cross-sectional view along J-J in FIG. 16.

Next, a belt adjusting and holding device in a second example of the present embodiment will be described below, referring to FIGS. 16 and 17. FIG. 16 is a plan view of the belt adjusting and holding device in an assembled state, i.e., a belt-locking state, in the second example of the present embodiment. FIG. 17 is a cross-sectional view along J-J in FIG. 16.

A belt adjusting and holding device 10B in the second example, as shown in FIGS. 16 and 17, configured to adjust the length of at least one belt 1 and hold the adjusted belt 1, includes a device body 2B including a belt insertion part 21 formed in a back end portion 211 and opening in a substantially rectangular shape to allow the belt 1 to be inserted forward and the opening section 22 having a substantially rectangular shape, communicating with the belt insertion part 21, and extending through in the upper-lower direction R2 perpendicular to the insertion direction of the belt 1, and the belt folding-back member 3 having a substantially plate shape configured to move forward and backward the front-back direction R1 within the device body 2B. The belt folding-back member 3 includes the folding-back part 31 configured to allow the belt 1 to wind around the front end 311 and fold backward within the opening section 22 of the device body 2, and the grasping part 32 located on the back end side of the folding-back part 31 and configured to project backward from the belt insertion part 21 together with the folded belt 1. Further, the belt insertion part 21 includes the upper inner wall surface 212 and the lower inner wall surface 213 which are respectively formed with the standing wall portion 212T and the standing wall portion 213T, each rising inward in a stepped shape on the side near the opening section 22 and extending almost continuously in the belt width direction R3 between the right and left sidewalls 23. The folding-back part 31 includes the upper end face 312 and the lower end face 313, at least one of which is formed with protrusions 33, which are disposed near back of the standing wall portion 212T or 213T when the belt folding-back member 3 is moved to the backward position P1, bending the belt 1 into a substantially stepped shape between the protrusions 33 and the standing wall portion 212T or 213T, and which are disposed in the opening section 22 when the belt folding-back member 3 is moved to the forward position P2, releasing the belt 1 from bending. The above configurations are common with those in the first example. Herein, similar or identical parts to those in the first example are assigned the same reference signs and basically their details will be omitted, and the following description is given with a focus on differences from the first example.

Specifically, in the belt adjusting and holding device 10B in the second example, the device body 2B includes a belt fixing frame 25 on the front end side of the opening section 22, the belt fixing frame 25 being configured to fix thereto a belt 1K for length fixation. In this example, at a position adjacent to the belt folding-back member 3 moved to the forward position P2, the belt fixing frame 25 has a straight shape extending in the belt width direction R3 and joining to the front ends of the sidewalls 23. The belt fixing frame 25 has a substantially rectangular cross-section and the belt 1K for length fixation is wound around the belt fixing frame 25 and fixed thereon.

According to the belt adjusting and holding device 10B in the second example configured as above, the belt 1 for length adjustment can be fixed with the adjustable length on the back end side of the device body 2B through the belt folding-back member 3, while the belt 1K for length fixation can be fixed on the front end side of the device body 2B through the belt fixing frame 25. Thus, the device body 2B for connecting both the belts 1 and 1K can be downsized and slimmed, resulting in an improved handleability and operability in use. Consequently, the belt adjusting and holding device 10B can be provided without an excessive device thickness and capable of easily adjusting the length of the belt 1 and holding the adjusted belt 1.

<Belt Adjusting and Holding Device in Third Example>

Figure 18:
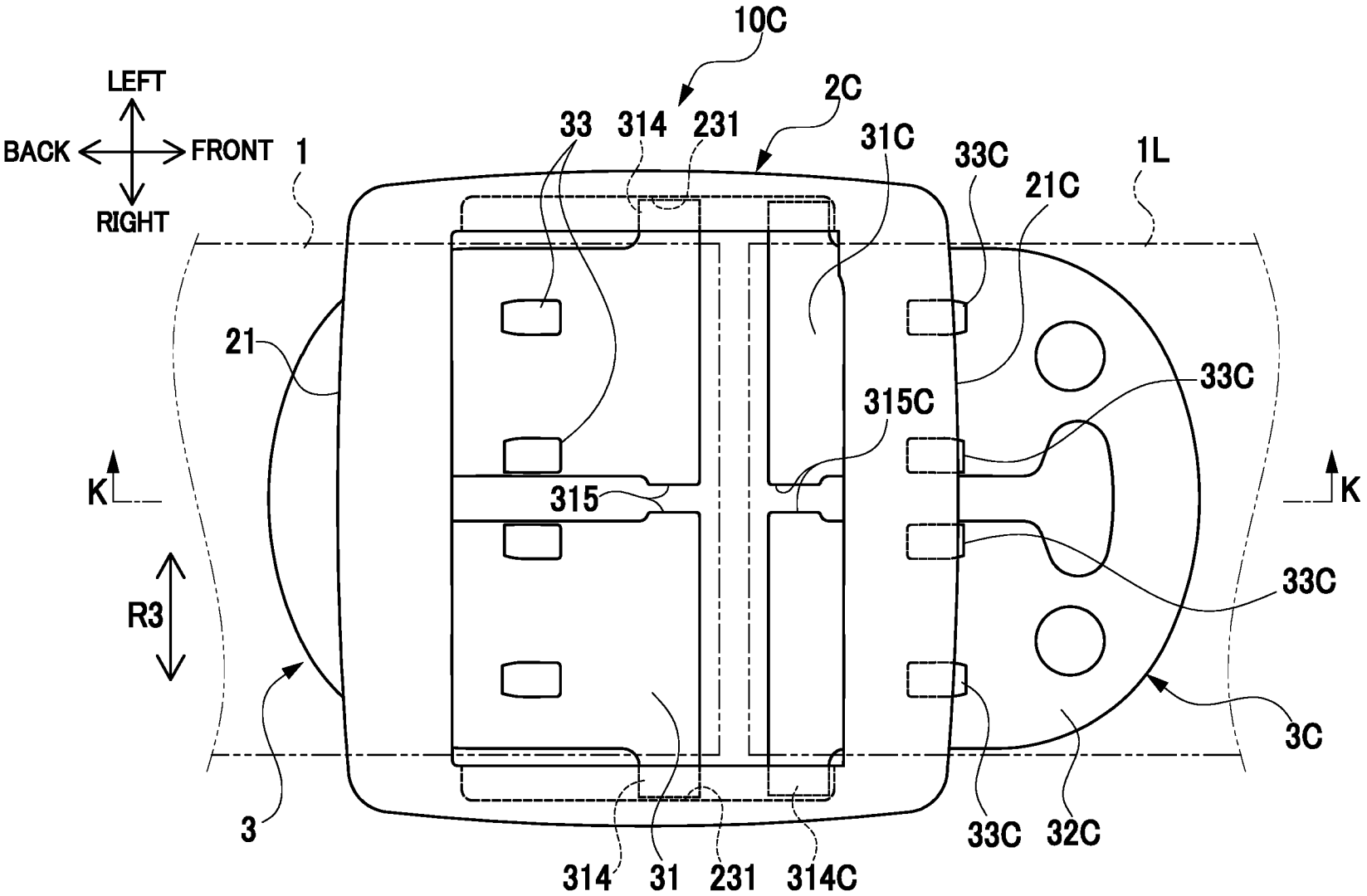
FIG. 18 is a plan view of a belt adjusting and holding device in an assembled state, i.e., a belt-locking state, in a third example of the embodiment.
Figure 19:
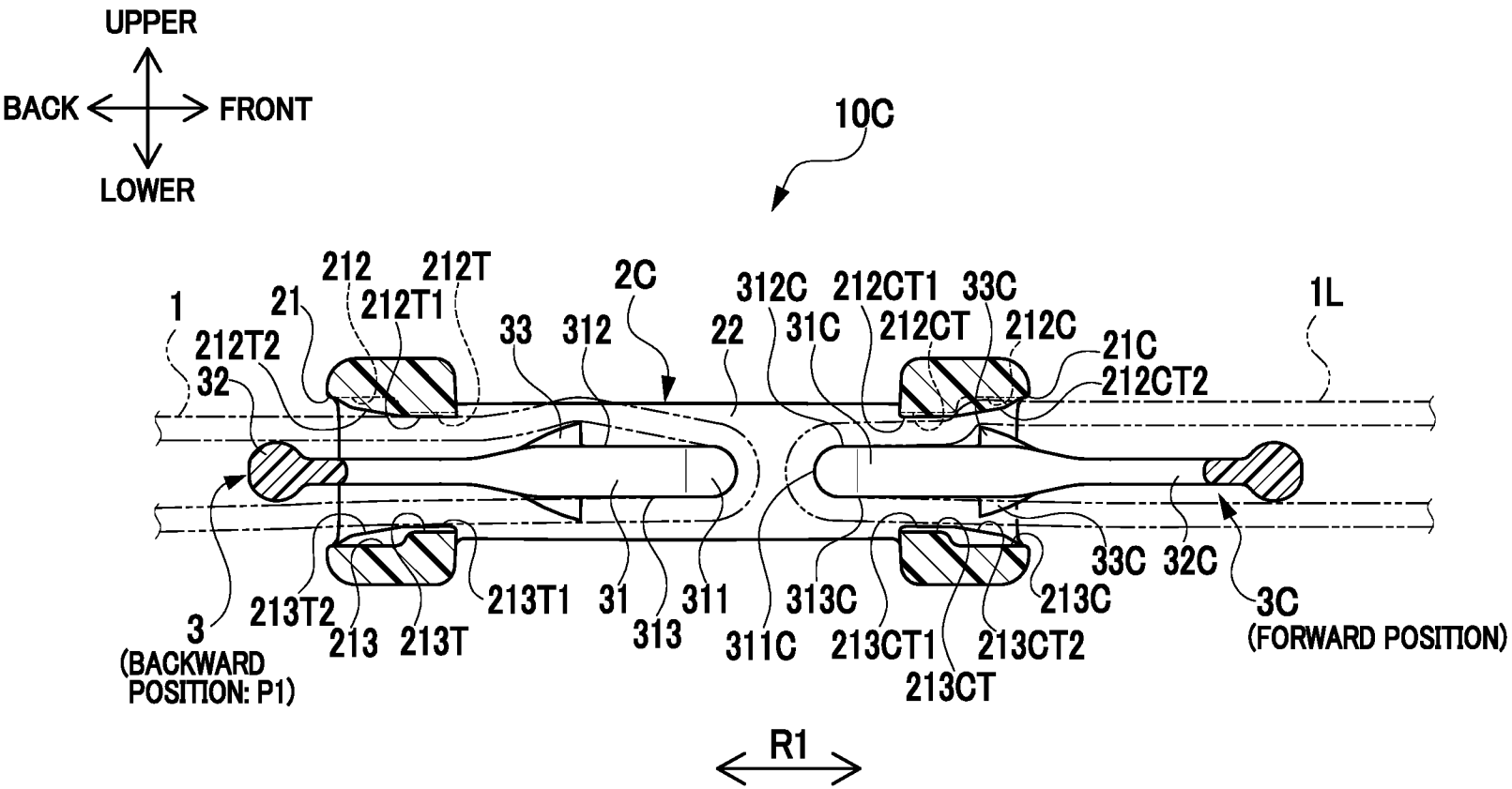
FIG. 19 is a cross-sectional view along K-K in FIG. 18.
Figure 20A:
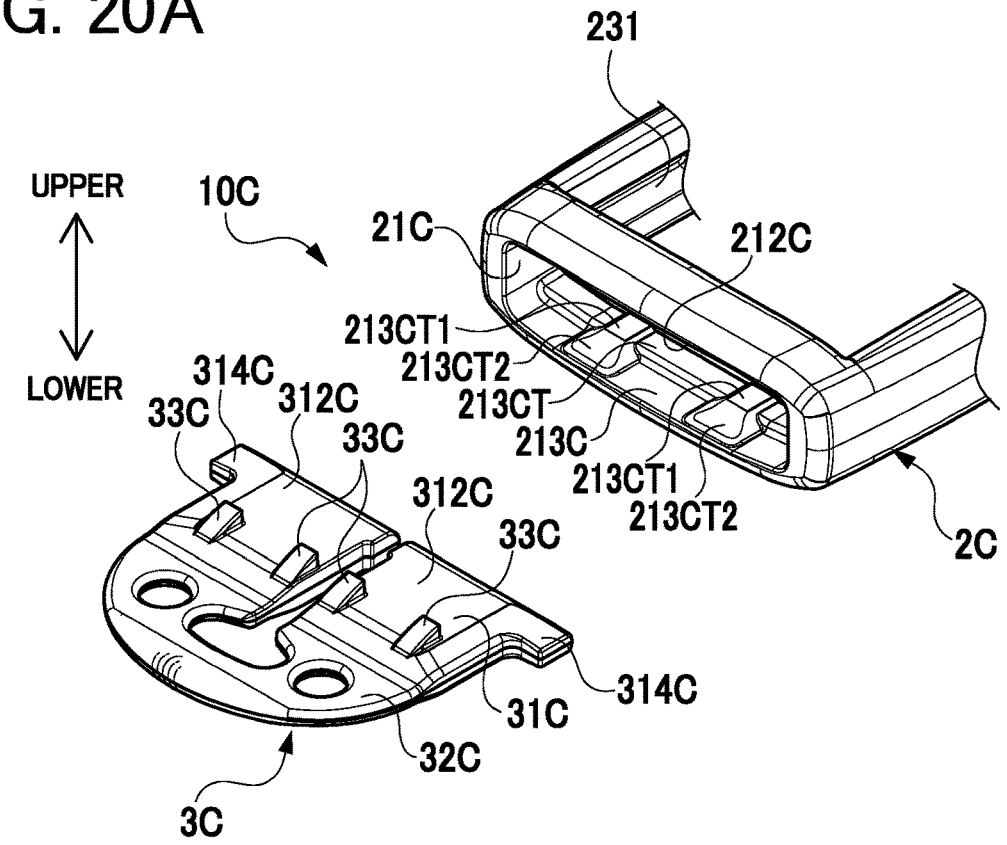
FIG. 20A is a perspective view of a device body and a second belt folding-back member of the belt adjusting and holding device shown in FIG. 18 in the third example, seen from an obliquely front upper side.
Figure 20B:
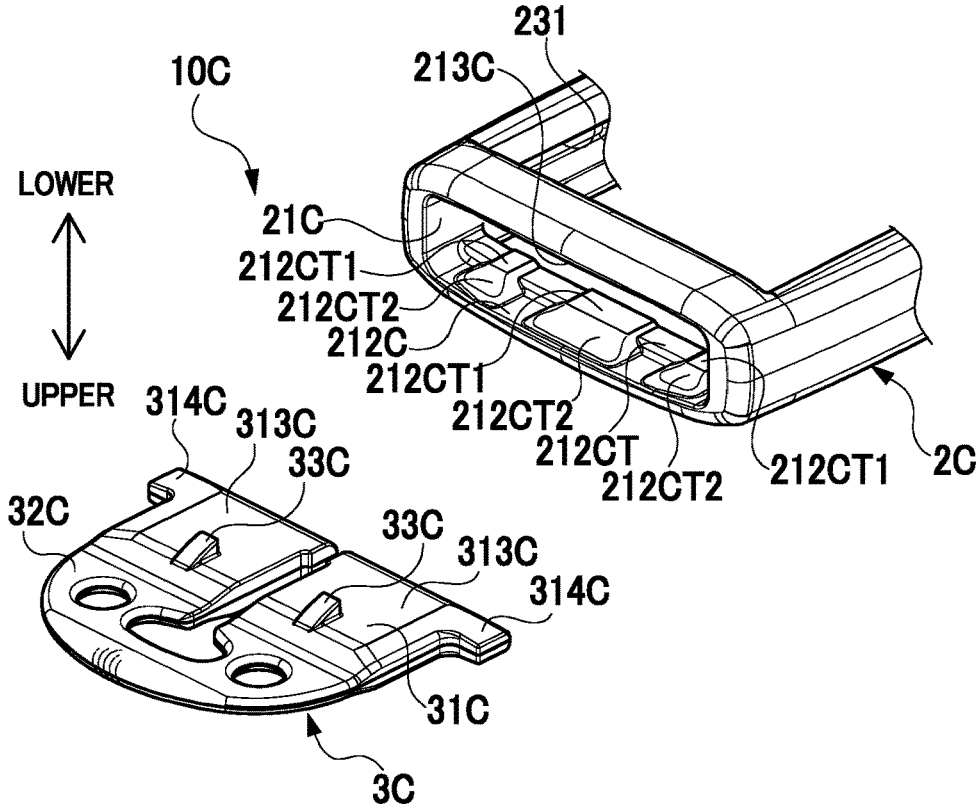
FIG. 20B is a perspective view of the device body and the second belt folding-back member of the belt adjusting and holding device shown in FIG. 18 in the third example, seen from an obliquely front lower side.

Next, a belt adjusting and holding device in a third example of the present embodiment will be described below, referring to FIGS. 18 to 20. FIG. 18 is a plan view of the belt adjusting and holding device in an assembled state, i.e., a belt-locking state, in the third example of the present embodiment. FIG. 19 is a cross-sectional view along K-K in FIG. 18. FIG. 20A is a perspective view of a device body and a second belt folding-back member of the belt adjusting and holding device shown in FIG. 18 in the third example, seen from an obliquely front upper side. FIG. 20B is a perspective view of the device body and the second belt folding-back member of the belt adjusting and holding device shown in FIG. 18 in the third example, seen from an obliquely front lower side.

A belt adjusting and holding device 10C in the third example, as shown in FIGS. 18 to 20B, configured to adjust the length of at least one belt 1 and hold the adjusted belt 1, includes a device body 2C including a belt insertion part 21 formed in a back end portion 211 and opening in a substantially rectangular shape to allow the belt 1 to be inserted forward and the opening section 22 having a substantially rectangular shape, communicating with the belt insertion part 21, and extending through in the upper-lower direction R2 perpendicular to the insertion direction of the belt 1, and the belt folding-back member 3 having a substantially plate shape configured to move forward and backward in the front-back direction R1 within the device body 2C. The belt folding-back member 3 includes the folding-back part 31 configured to allow the belt 1 to wind around the front end 311 and fold backward within the opening section 22, and the grasping part 32 located on the back end side of the folding-back part 31 and configured to project backward from the belt insertion part 21 together with the folded belt 1. Further, the belt insertion part 21 includes the upper inner wall surface 212 and the lower inner wall surface 213, which are respectively formed with the standing wall portion 212T and the standing wall portion 213T, each rising inward in a stepped shape on the opening section 22 side and extending almost continuously in the belt width direction R3 between right and left sidewalls 23. The folding-back part 31 includes the upper end face 312 and the lower end face 313, at least one of which is formed with protrusions 33, which are disposed near back of the standing wall portion 212T or 213T when the belt folding-back member 3 is moved to the backward position P1, bending the belt 1 into a substantially stepped shape between the protrusions 33 and the standing wall portion 212T or 213T, and which are disposed in the opening section 22 when the belt folding-back member 3 is moved to the forward position P2, releasing the belt 1 from bending. The above configurations are common with those in the first example. Herein, similar or identical parts to those in the first example are assigned the same reference signs and basically their details will be omitted, and the following description is given with a focus on differences from the first example.

Specifically, in the belt adjusting and holding device 10C in the third example, the device body 2C includes a second belt insertion part 21C formed on the front end side of the opening section 22 and opening in a substantially rectangular shape to allow a second belt 1L for length adjustment to be inserted backward. In addition, the device 10C further includes a second belt folding-back member 3C having a substantially plate shape configured to move forward and backward in the front-back direction R1 within the device body 2C. The second belt folding-back member 3C includes a second folding-back part 31C configured to allow the second belt 1L to wind around a back end 311C and turn back toward the front, or fold forward, within the opening section 22, and a second grasping part 32C located on a front end side of the second folding-back part 31C and configured to project forward from the second belt insertion part 21C together with the folded second belt 1L.

The second belt folding-back member 3C is formed with guide projections 314C having the almost the same shape as the guide projections 314 of the belt folding-back member 3, and the guide projections 314C engage with the guide grooves 231. In this case, the guide grooves 231 can be used in common between the belt folding-back member 3 and the second belt folding-back member 3C, so that the overall length of the guide grooves 231 can be shortened, contributing to downsizing of the device.

The second folding-back part 31C includes right and left portions separated at the center in the belt width direction R3 and joined to each other in a nearly U shape through the grasping part 32C. The folding-back part 31C is formed, on the center side of the right and left separated portions, with a pair of contact portions 315C facing each other with a predetermined gap. Thus, while the second belt folding-back member 3C is disposed at the forward position, fixing the belt 1L to the device body 2C, even when the belt 1L is strongly pulled, the right and left contact portions 315C contact with and push against each other, thereby keeping the guide projections 314C engaged in the guide grooves 231. Accordingly, the second belt folding-back member 3C can avoid from falling off from the device body 2C, and hence reliably fix the belt 1L to the device body 2C.

The second belt insertion part 21C includes an upper inner wall surface 212C and a lower inner wall surface 213C which have respectively formed with a second standing wall portion 212CT and a standing wall portion 213CT, each rising inward in a stepped shape on the side near the opening section 22 and extending almost continuously in the belt width direction R3 between right and left sidewalls 23. The second folding-back part 31C includes an upper end face 312C and a lower end face 313C, at least one of which is formed with second protrusions 33C, which are disposed near front of the second standing wall portion 212CT or 213CT when the second belt folding-back member 3C is moved to the forward position, bending the second belt 1L into a substantially stepped shape between the second protrusions 33C and the second standing wall portion 212CT or 213CT, and which are disposed in the opening section 22 when the second belt folding-back member 3C is moved to the backward position, releasing the second belt 1L from bending. The second protrusions 33C each have a shape that is highest at a back end and gradually lower toward a front end.

In the belt adjusting and holding device 10C in the third example configured as above, when fixing the second belt 1L to the device body 2C, the second belt folding-back member 3C is moved to the forward position together with the folded second belt 1L, bending the second belt 1L into a substantially stepped shape between the second standing wall portion 212CT or 213CT and the second protrusions 33C, so that the second belt 1L is prevented from moving by its deformation resistance. Furthermore, since the second belt folding-back member 3C is not allowed to move forward more than the forward position relative to the device body 2C, even when the second belt 1L is pulled strongly, the second belt 1L does not move with respect to the device body 2C. Therefore, by simply moving the second belt folding-back member 3C together with the folded second belt 1L to the forward position, the second belt 1L can be easily fixed to the device body 2C.

In order to adjust the length of the second belt 1L with respect to the device body 2C, it is only necessary to move the second belt folding-back member 3C together with the folded second belt 1L to the backward position. Specifically, when the second belt folding-back member 3C is moved to the backward position, the second protrusions 33C are moved into the opening section 22, and therefore that the second belt 1L wound around the second folding-back part 31C of the second belt folding-back member 3C moved to the backward position is released from bending by the second protrusions 33C and the second standing wall portion 212CT or 213CT, so that the second belt 1L is allowed to freely move within the opening section 22. Thus, the length of the second belt 1L can be easily adjusted with respect to the device body 2C by simply moving the second belt folding-back member 3C together with the folded second belt 1L to the backward position.

While the second belt folding-back member 3C, which has been moved together with the folded second belt 1L, is disposed at the forward position, the second belt 1L is bent in a substantially stepped shape between the second standing wall portions 212CT and 213CT and the protrusions 33C. To move this second belt folding-back member 3C from the forward position to the backward position, it is necessary to apply a force to cause the second protrusions 33C to pass over the second standing wall portions 212CT and 213CT together with the second belt 1L. The second belt folding-back member 3C is therefore locked at the forward position through the bent second belt 1L. Accordingly, even when the second belt 1L is not in use, the second belt 1L is not displaced with respect to the device body 2C, thus eliminating the need for readjustment of the belt adjusting and holding device 10C each time the second belt 1L is used.

The device body 2C includes the second belt insertion part 21C formed on the front end side of the opening section 22 and opening in a substantially rectangular shape to allow the second belt 1L for length adjustment to be inserted backward. The second belt folding-back member 3C, which has a substantially plate shape and is configured to move forward and backward in the front-back direction R1 within the device body 2C, includes the second folding-back part 31C configured to allow the second belt 1L to wind around the back end 311C and fold forward within the opening section 22, and the second grasping part 32C located on the front end side of the second folding-back part 31C and configured to project forward from the second belt insertion part 21C together with the folded second belt 1L. In the second belt folding-back member 3C, the second folding-back part 31C has a thickness in the upper-lower direction R2 set to a minimum thickness needed for folding back the second belt 1L. Thus, the thickness of the device can be easily prevented from becoming excessive. Therefore, the belt adjusting and holding device 10C in the third example can be provided without an excessive device thickness and capable of easily adjusting and holding the lengths of the belts 1 and 1L, eliminating the need for readjustment at each use.

Furthermore, the belt adjusting and holding device 10C in the third example is preferably configured as below. The second protrusions 33C are arranged on the upper end face 312C and the lower end face 313C of the second folding-back part 31C, at different positions in the belt width direction R3 for each end face. The second standing wall portion 212CT formed on the upper inner wall surface 212C of the second belt insertion part 21C is formed with third raised portions 212CT1 protruding inward at the positions facing the second protrusions 33C formed on the upper end face 312C of the second folding-back part 31C. The second standing wall portion 213CT formed on the lower inner wall surface 213C of the second belt insertion part 21C is formed with fourth raised portions 213CT1 protruding inward at the positions facing the second protrusion 33C formed on the lower end face 313C of the second folding-back part 31C. The second belt folding-back member 3C is configured to move, even in an upside-down state, forward and backward in the front-back direction R1 within the second device body 2C. In this case, while the second belt folding-back member 3C, not turned upside down, moved together with the folded second belt 1L is disposed at the forward position, the gaps between the third raised portions 212CT1 and the upper end face 312C of the second folding-back part 31C are narrowed just by the height of the third raised portions 212CT1 at the positions where the third raised portions 212CT1 face the corresponding second protrusions 33C, and the gaps between the fourth raised portions 213CT1 and the lower end face 313C of the second folding-back part 31C are narrowed just by the height of the fourth raised portions 213CT1 at the positions where the fourth raised portions 213CT1 face the corresponding second protrusions 33C. Therefore, even the belt 1L having a relatively tinner thickness than the gap between each standing wall portion 212CT and 213CT and the second folding-back part 31C can be bent into a substantially stepped shape between the second protrusions 33C and the third raised portions 212CT1 and between the second protrusions 33C and the fourth raised portions 213CT1. Thus, even the thin belt 1L can be firmly fixed to the device body 2C.

In contrast, when the second belt folding-back member 3C is turned upside down with respect to the device body 2C, the second protrusions 33C are arranged at different positions in the belt width direction R3 with respect to the third raised portions 212CT1 and the fourth raised portions 213CT1. Thus, while the upside-down second belt folding-back member 3C, which has been moved together with the folded second belt 1L, is disposed at the forward position, this belt 1L is bent in a substantially stepped shape between the second standing wall portions 212CT and 213CT and the second protrusions 33C without being influenced by the third raised portions 212CT1 and the fourth raised portions 213CT1, so that the second belt 1L is prevented from moving by its deformation resistance. When the second belt folding-back member 3C in the upside-down state is moved to the forward position, the second belt folding-back member 3C can more firmly fix the thick belt 1L to the device body 2C as compared with the second belt folding-back member 3C not turned upside down. As a result, a single belt adjusting and holding device 10C can adjust the length of different belts 1L of different thicknesses and hold the adjusted belt 1L by simple operation of turning the second belt folding-back member 3C upside down and attaching it to the device body 2C.

In the belt adjusting and holding device 10C in the third example, preferably, the third raised portions 212CT1 are each formed, on the front end side, with a third inclined surface 212CT2 inclined front-upward toward the upper inner wall surface 212C of the second belt insertion part 21C, and the fourth raised portions 213CT1 are each formed, on the front end side, with a fourth inclined surface 213CT2 inclined front-downward toward the lower inner wall surface 213C of the second belt insertion part 21C.

In this case, for example, when the second belt folding-back member 3C not turned upside down is moved from the forward position to the backward position, the second belt 1L bent by the second protrusion 33C formed on the upper end face 312C of the second folding-back part 31C presses upward the third raised portions 212CT1 through the third inclined surfaces 212CT2, and the second belt 1L bent by the second protrusions 33C formed on the lower end face 313C of the second folding-back part 31C presses downward the fourth raised portions 213CT1 through the fourth inclined surfaces 213CT2, resiliently warping the upper inner wall surface 212C and the lower inner wall surface 213C of the second belt insertion part 21C to easily expand the gap between these inner wall surfaces. This can reduce the force needed to move the second belt folding-back member 3C from the forward position to the backward position, so that the length of the second belt 1L can be adjusted with respect to the device body 2C with less operating force.

<Belt Adjusting and Holding Device in Fourth Example>

Figure 21:
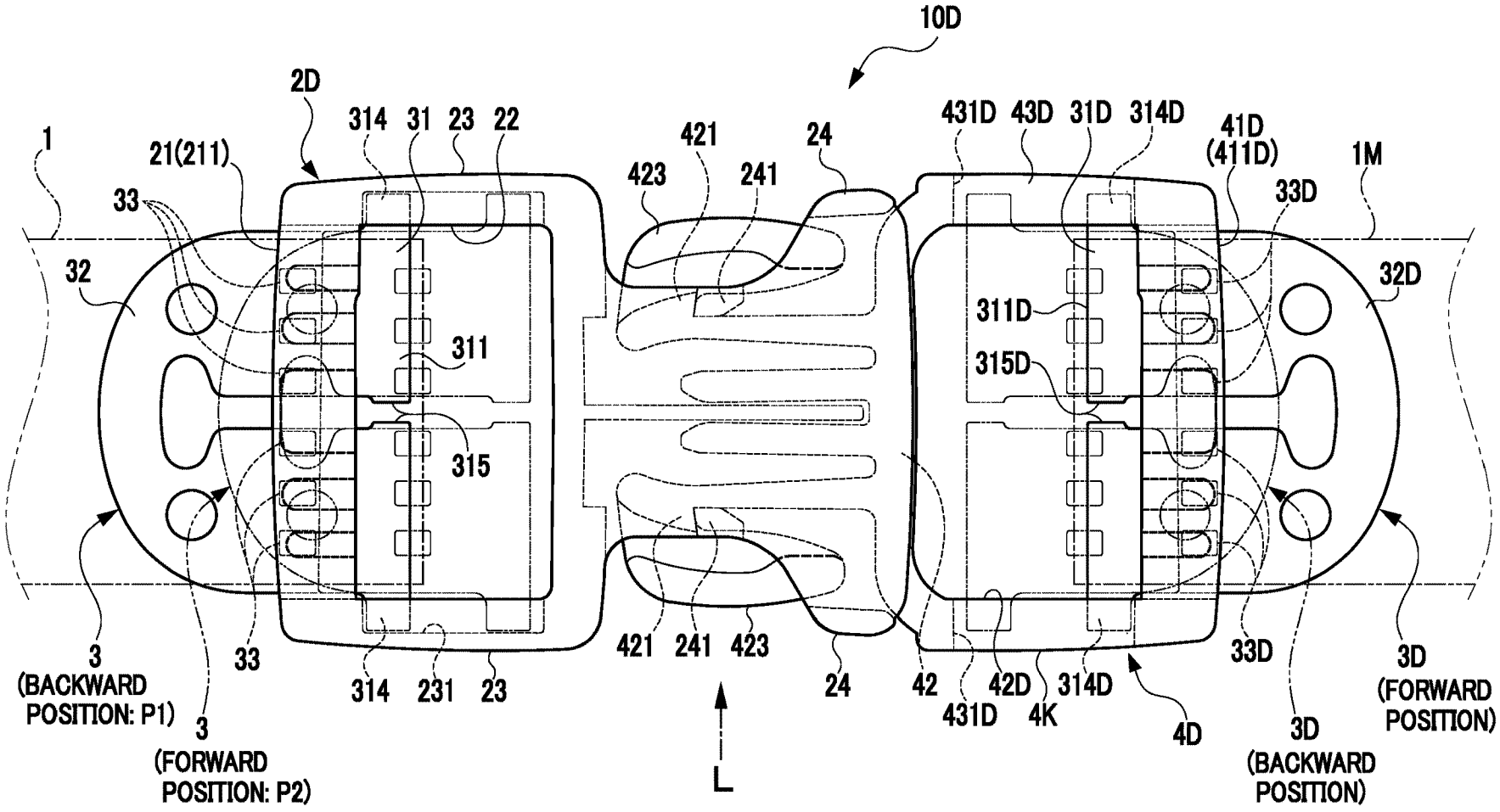
FIG. 21 is a plan view of a belt adjusting and holding device in an assembled state, i.e., a belt-locking state, in a fourth example of the embodiment.
Figure 22:
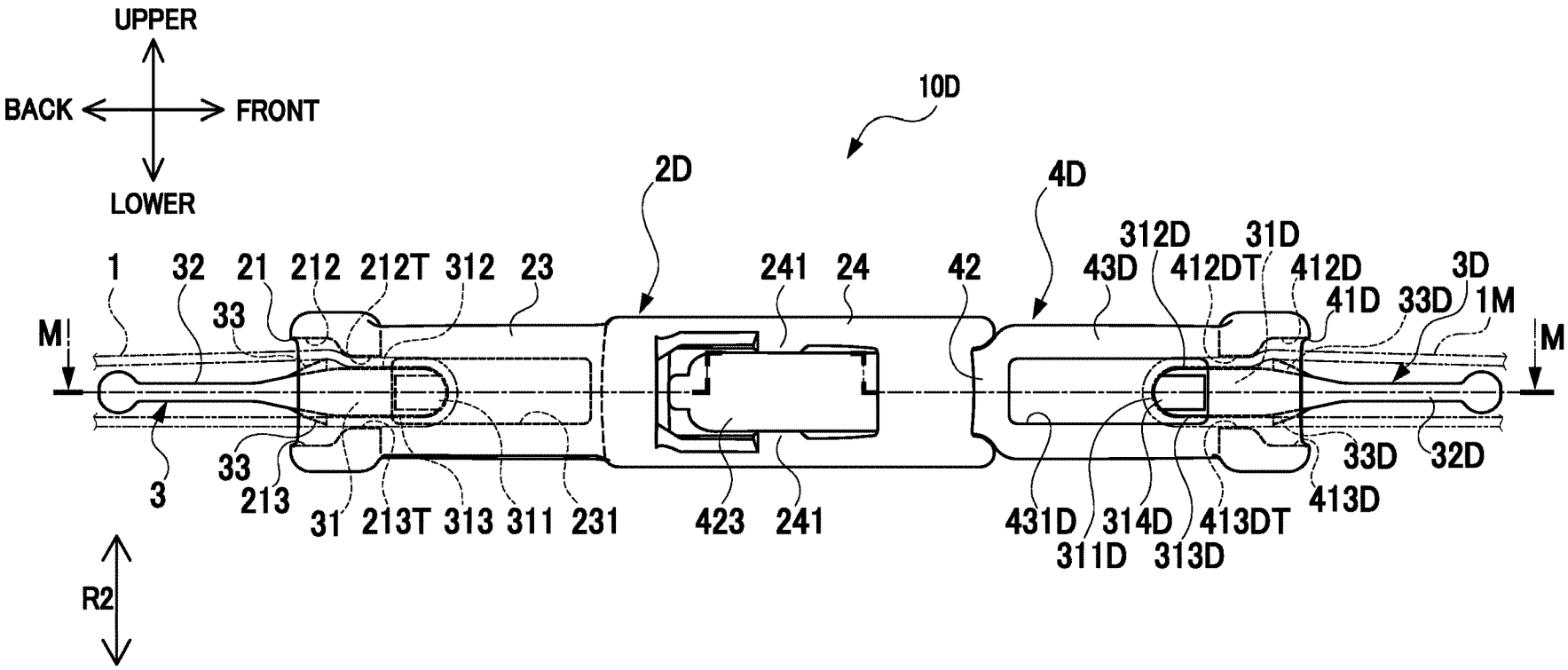
FIG. 22 is a view of the belt adjusting and holding device seen as indicated by an arrow L in FIG. 21.
Figure 23:
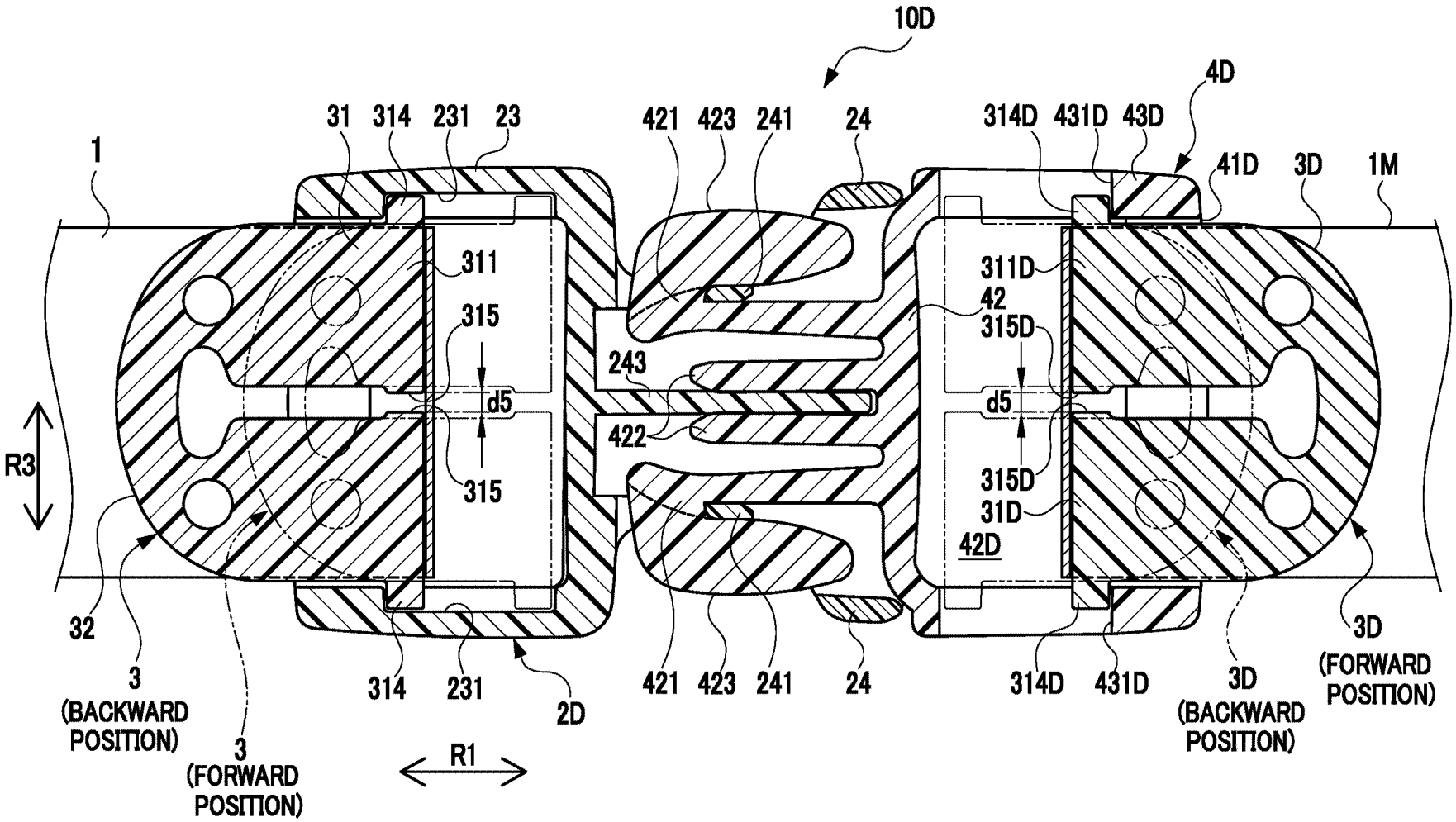
FIG. 23 is a cross-sectional view along M-M in FIG. 22.
Figure 24A:
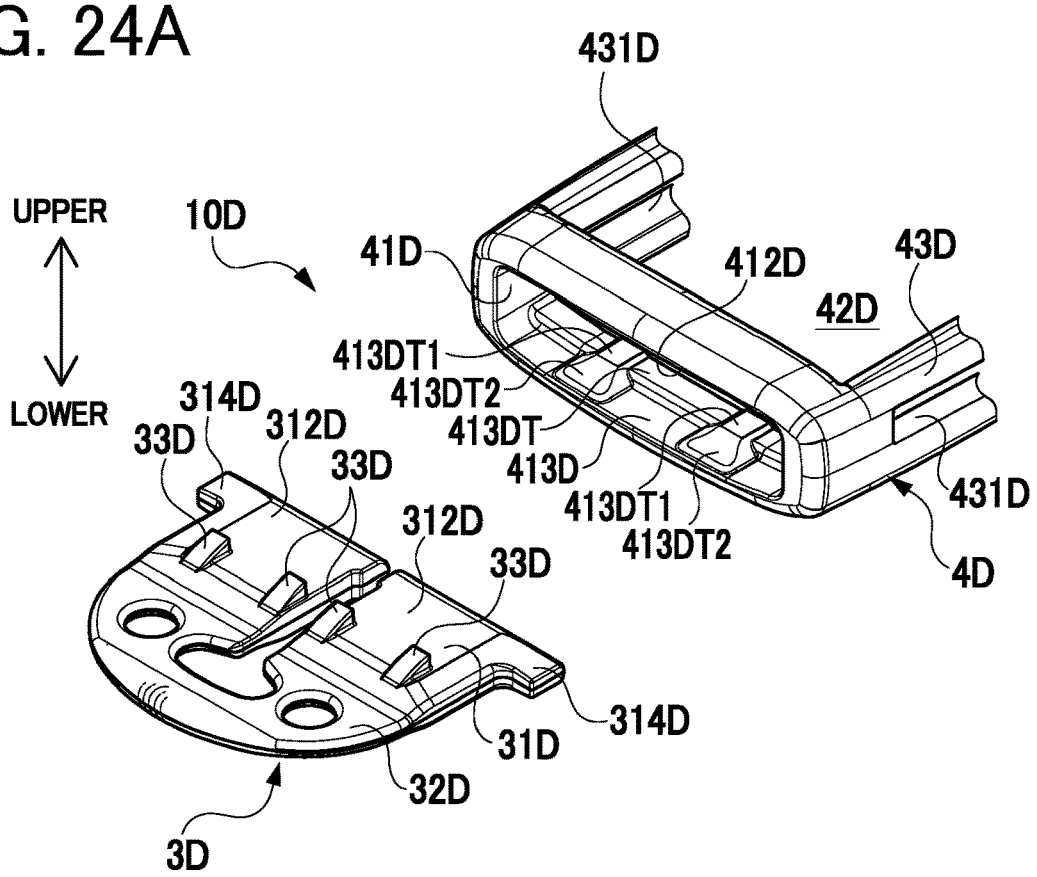
FIG. 24A is a perspective view of a striker body and a third belt folding-back member of the belt adjusting and holding device in the fourth example shown in FIG. 21, seen from an obliquely front upper side.
Figure 24B:
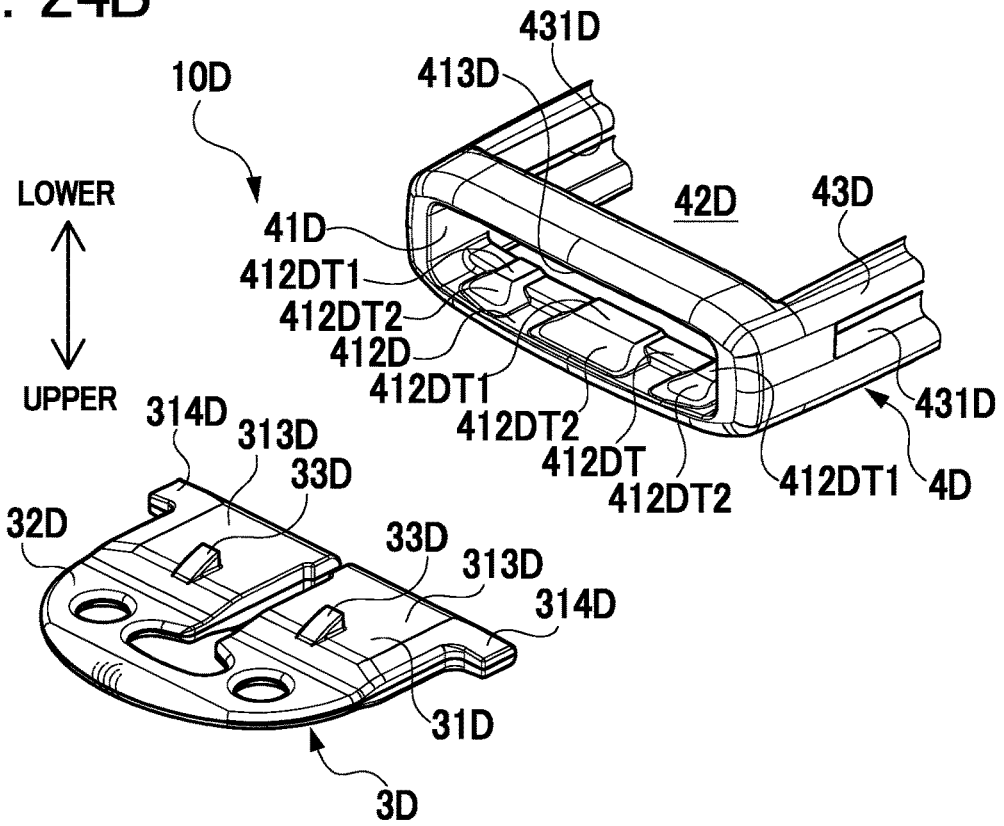
FIG. 24B is a perspective view of the striker body and the third belt folding-back member of the belt adjusting and holding device in the fourth example shown in FIG. 21, seen from an obliquely front lower side.
Figure 25:
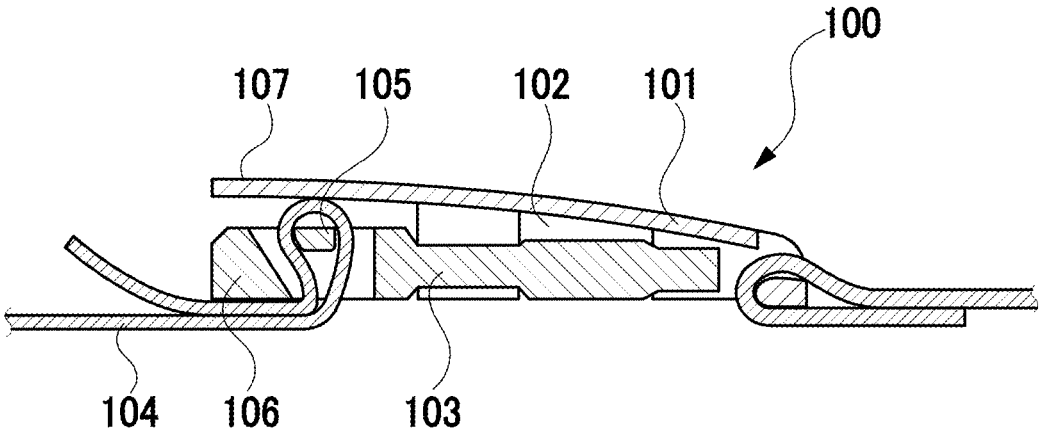
FIG. 25 (Prior Art)
FIG. 25 is a vertical cross-sectional view of a buckle disclosed in Patent literature 1.
Figure 26:
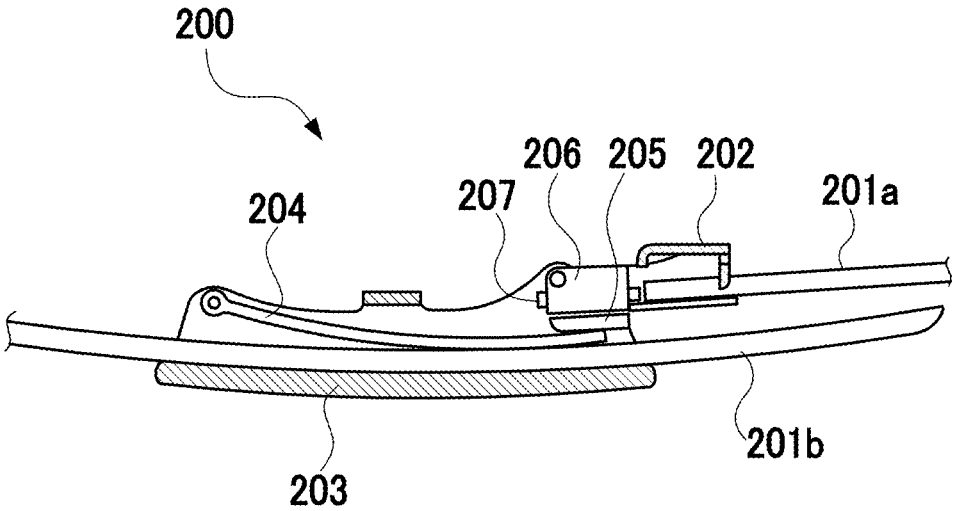
FIG. 26 (Prior Art)
FIG. 26 is a vertical cross-sectional view of a buckle disclosed in Patent literature 2.

Next, a belt adjusting and holding device in a fourth example of the present embodiment will be described, referring to FIGS. 21 to 24. FIG. 21 is a plan view of a belt adjusting and holding device in an assembled state, i.e., a belt-locking state, in the fourth example of the present embodiment. FIG. 22 is a view of the belt adjusting and holding device seen as indicated by an arrow L in FIG. 21. FIG. 23 is a cross-sectional view along M-M in FIG. 22. FIG. 24A is a perspective view of a striker body and a third belt folding-back member of the belt adjusting and holding device in the fourth example shown in FIG. 21, seen from an obliquely front upper side. FIG. 24B is a perspective view of the striker body and the third belt folding-back member of the belt adjusting and holding device in the fourth example shown in FIG. 21, seen from an obliquely front lower side.

A belt adjusting and holding device 10D in the fourth example, as shown in FIGS. 21 to 24B, configured to adjust the length of at least one belt 1 and hold the adjusted belt 1, includes a device body 2D including the belt insertion part 21 formed in the back end portion 211 and opening in a substantially rectangular shape to allow the belt 1 to be inserted forward and the opening section 22 having a substantially rectangular shape, communicating with the belt insertion part 21, and extending through in the upper-lower direction R2 perpendicular to the insertion direction of the belt 1, and the belt folding-back member 3 having a substantially plate shape configured to move forward and backward in the front-back direction R1 within the device body 2D. The belt folding-back member 3 includes the folding-back part 31 configured to allow the belt 1 to wind around the front end 311 and fold backward within the opening section 22, and the grasping part 32 located on the back end side of the folding-back part 31 and configured to project backward from the belt insertion part 21 together with the folded belt 1. Further, the belt insertion part 21 includes the upper inner wall surface 212 and the lower inner wall surface 213, which are respectively formed with the standing wall portion 212T and the standing wall portion 213T, each rising inward in a stepped shape on the opening section 22 side and extending almost continuously in the belt width direction R3 between the right and left sidewalls 23. The folding-back part 31 includes the upper end face 312 and the lower end face 313, at least one of which is formed with the protrusions 33, which are placed rear back of the standing wall portion 212T or 213T when the belt folding-back member 3 is disposed at the backward position P1, bending the belt 1 into a substantially stepped shape between the protrusions 33 and the standing wall portions 212T and 213T, and which are placed in the opening section 22 when the belt folding-back member 3 is disposed at the forward position P2, releasing the belt 1 from bending. The above configurations are common with those in the first example. Herein, similar or identical parts to those in the first example are assigned the same reference signs and basically their details will be omitted, and the following description is given with a focus on differences from the first example.

Specifically, the belt adjusting and holding device 10C in the fourth example further includes a second striker 4D having a proximal end portion 4K to which a third belt 1M for length adjustment is fixed with an adjustable length, and a distal end portion 42 formed with locking pawls 421. The device body 2D includes, on the front end side of the opening section 22, a striker housing part 24 configured to detachably hold the second striker 4D, and engaging protrusions 241 located in the striker housing part 24 and configured to engage with the locking pawls 421 of the second striker 4D.

In this example, similar to the first example, the distal end portion 42 of the second striker 4D is formed with separated right and left insertion leg portions 422 located on the center side and operating portions 423 are located on the right and left outer sides of the insertion leg portions 422, the operating portions 423 including the locking pawls 421. The striker housing part 24, the housing chamber 242 includes the housing chamber 242 formed with the guide rib 243 for guiding the insertion leg portions 422 in the front-back direction R1 and the engaging protrusions 241 configured to engage with the locking pawls 421 of the second striker 4D. The engaging protrusions 241 are formed separately on the upper inner wall and the lower inner wall of the housing chamber 242. When the distal end portion 42 of the second striker 4D is inserted into the housing chamber 242, the operating portions 423 of the second striker 4D pass between the separated upper and lower engaging protrusions 241 while being pressed and deformed by the engaging protrusions 241. When this insertion is completed, the locking pawls 421 engage with the engaging protrusions 241. In contrast, by pressing the right and left operating portions 423, the locking pawls 421 and the engaging protrusions 241 can be disengaged.

In this case, the belt 1 for length adjustment is fixed with an adjustable length to the back end side of the device body 2D through the belt folding-back member 3, while the third belt 1M for length adjustment is detachably connected to the device body 2D through the second striker 4D in the striker housing part 24 formed on the front end side of the device body 2D. Therefore, the belt folding-back member 3 and the second striker 4D can be arranged adjacent to each other in the front-back direction R1 of the device body 2D, without overlapping one on the other in the upper-lower direction R2. As a result, the device can be slimmed, thus resulting in an improved external appearance and an enhanced handleability and operability.

The belt adjusting and holding device 10D in the fourth example is preferably configured as below. The proximal end portion 4K of the second striker 4D is provided with a third belt insertion part 41D opening in a substantially rectangular shape to allow the third belt 1M to be inserted backward from a front end portion 411D, and a second opening section 42D having a substantially rectangular shape, communicating with the third belt insertion part 41D, and extending through in the upper-lower direction R2 perpendicular to the insertion direction of the third belt 1M. The belt adjusting and holding device 10D further includes a third belt folding-back member 3D having a substantially plate shape configured to move forward and backward in the front-back direction R1 within the second striker 4D. The third belt folding-back member 3D includes a third folding-back part 31D configured to allow the third belt 1M to wind around a back end 311D and fold forward within the second opening section 42D, and a third grasping part 32D located on a front end side of the third folding-back part 31D and configured to project forward from the third belt insertion part 41D together with the folded third belt 1M. The third belt insertion part 41D includes an upper inner wall surface 412D and a lower inner wall surface 413D which are respectively formed with a third standing wall portion 412DT and a third standing wall portion 413DT, each rising inward in a stepped shape on the side near the second opening section 42D and extending almost continuously in the belt width direction R3 between right and left sidewalls 43D of the second striker 4D. The third folding-back part 31D includes an upper end face 312D and a lower end face 313D, at least one of which is formed with third protrusions 33D, which are disposed near front of the third standing wall portions 412DT and 413DT when the third belt folding-back member 3D is moved to the forward position, bending the third belt 1M into a substantially stepped shape between the third protrusions 33D and the third standing wall portions 412DT and 413DT, and which are disposed in the second opening section 42D when the third belt folding-back member 3D is moved to the backward position, releasing the third belt 1M from bending.

The third belt folding-back member 3D is formed with guide projections 314D having almost the same shape as the guide projections 314 of the belt folding-back member 3. The second striker 4D is formed with guide grooves 431D on the right and left sidewalls 43D, engaging with the guide projections 314D. These guide grooves 431D are each formed extending through the sidewalls 43D, from the forward position to the backward position of the third belt folding-back member 3D, in parallel to the belt width direction R3. The third protrusions 33D each have a shape that is highest at a back end and gradually lower toward the front end side.

The third folding-back part 31D includes right and left portions separated at the center in the belt width direction R3 and joined to each other in a nearly U shape through the grasping part 32D, similar to the folding-back part 31. The third folding-back part 31D is formed, on the center side of the right and left separated portions, with a pair of contact portions 315D facing each other with a predetermined gap d5. Thus, while the third belt folding-back member 3D is disposed at the forward position, fixing the third belt 1M to the second striker 4D, even when the third belt 1M is strongly pulled, the contact portions 315D contact with and push against each other, thereby keeping the guide projections 314D engaged in the guide grooves 431D. Accordingly, the third belt folding-back member 3D can avoid falling off from the second striker 4D, and hence reliably fix the third belt 1M to the second striker 4D.

In the belt adjusting and holding device 10D in the fourth example configured as above, when fixing the third belt 1M to the second striker 4D, the third belt folding-back member 3D is moved to the forward position together with the folded third belt 1M, bending the third belt 1M into a substantially stepped shape between the third standing wall portions 412DT and 413DT and the third protrusions 33D, so that the third belt 1M is prevented from moving by its deformation resistance. Furthermore, since the third belt folding-back member 3D is not allowed to move forward more than the forward position relative to the second striker 4D, even when the third belt 1M is pulled strongly, the third belt 1M does not move with respect to the second striker 4D. Therefore, by simply moving the third belt folding-back member 3D together with the folded third belt 1M to the forward position, the third belt 1M can be easily fixed to the second striker 4D.

In order to adjust the length of the third belt 1M with respect to the second striker 4D, it is only necessary to move the third belt folding-back member 3D together with the folded third belt 1M to the backward position. Specifically, when the third belt folding-back member 3D is moved to the backward position, the third protrusions 33D are moved into the second opening section 42D, and therefore the third belt 1M wound around the third folding-back part 31D of the third belt folding-back member 3D moved to the backward position is released from bending by the third protrusions 33D and the third standing wall portions 412DT and 413DT, so that the third belt 1M is allowed to freely move within the second opening section 42D. Thus, the length of the third belt 1M can be easily adjusted with respect to the second striker 4D by simply moving the third belt folding-back member 3D together with the folded third belt 1M to the backward position.

While the third belt folding-back member 3D, which has been moved together with the folded third belt 1M, is disposed at the forward position, the third belt 1M is bent in a substantially stepped shape between the third standing wall portions 412DT and 413DT and the third protrusions 33D. To move this third belt folding-back member 3D from the forward position to the backward position, it is necessary to apply a force to cause the third protrusions 33D to pass over the third standing wall portions 412DT and 413DT together with the bent third belt 1M. The third belt folding-back member 3D is therefore locked at the forward position through the bent third belt 1M. Accordingly, even when the third belt 1M is not in use, the third belt 1M is not displaced with respect to the second striker 4D, thus eliminating the need for readjustment of the belt adjusting and holding device 10D in this example each time the third belt 1M is used.

The second striker 4D is provided, on the front end side of the second opening section 42D, with the third belt insertion part 41D opening in a substantially rectangular shape to allow the third belt 1M for length adjustment to be inserted backward. The third belt folding-back member 3D having a substantially plate shape and configured to move forward and backward in the front-back direction R1 within the second striker 4D includes the third folding-back part 31D configured to allow the third belt 1M to wind around the back end 311D and fold forward within the second opening section 42D, and the third grasping part 32D located on the front end side of the third folding-back part 31D and configured to project forward from the third belt insertion part 41D together with the folded third belt 1M. In the third belt folding-back member 3D, the third folding-back part 31D has a thickness in the upper-lower direction R2 set to a minimum thickness needed for folding back the third belt 1M. Thus, the thickness of the device can be easily prevented from becoming excessive. Therefore, the belt adjusting and holding device 10D in the fourth example can be provided without an excessive device thickness and capable of easily adjusting and holding the lengths of the belts 1 and 1M, thus eliminating the need for readjustment at each use.

The belt adjusting and holding device 10D in the fourth example is preferably configured as below. The third protrusions 33D are formed on the upper end face 312D and the lower end face 313D of the third folding-back part 31D, at different positions in the belt width direction R3 for each end face. The third standing wall portion 412DT formed on the upper inner wall surface 412D of the third belt insertion part 41D is formed with fifth raised portions 412DT1 protruding inward at the positions facing the third protrusions 33D formed on the upper end face 312D of the third folding-back part 31D. The third standing wall portion 413DT formed on the lower inner wall surface 413D of the third belt insertion part 41D is formed with sixth raised portions 413DT1 protruding inward at the positions facing the third protrusions 33D formed on the lower end face 313D of the third folding-back part 31D. The third belt folding-back member 3D is configured to move, even in an upside-down state, forward and backward in the front-back direction R1 within the second striker 4D.

In this case, while the third belt folding-back member 3D, not turned upside down, moved together with the folded third belt 1M is disposed at the forward position, the gaps between the fifth raised portions 412DT1 and the upper end face 312D of the third folding-back part 31D are narrowed just by the height of the fifth raised portions 412DT1 at the positions where the fifth raised portions 412DT1 face the corresponding third protrusions 33D, and the gaps between the sixth raised portions 413DT1 and the lower end face 313D of the third folding-back part 31D are narrowed just by the height of the six raised portions 413DT1 at the positions where the sixth raised portions 413DT1 face the corresponding third protrusions 33D. Therefore, even the third belt 1M having a relatively thinner thickness than the gap between each standing wall portion 412DT and 413DT and the third folding-back part 31D can be bent into a substantially stepped shape between the third protrusions 33D and the fifth raised portions 412DT1 and between the third protrusions 33D and the sixth raised portions 413DT1. Thus, even the thin belt 1M can be firmly fixed to the second striker 4D.

In contrast, when the third belt folding-back member 3D is turned upside down with respect to the second striker 4D, the third protrusions 33D are arranged at different positions in the belt width direction R3 with respect to the fifth raised portions 412DT1 and the sixth raised portions 413DT1. Thus, while the upside-down third belt folding-back member 3D, which has been moved together with the folded third belt 1M, is disposed at the forward position, this third belt 1M can be bent in a substantially stepped shape between the third standing wall portions 412DT and 413DT and the third protrusions 33D without being influenced by the fifth raised portions 412DT1 and the sixth raised portions 413DT1, so that the third belt 1M is prevented from moving by its deformation resistance. When the third belt folding-back member 3D in the upside-down state is moved to the forward position, this third belt folding-back member 3D can more firmly fix the thick belt 1M to the second striker 4D as compared with the third belt folding-back member 3D not turned upside down. As a result, a single belt adjusting and holding device 10D can adjust the length of different third belts 1M of different thicknesses and hold the adjusted belt 1M by simple operation of turning the third belt folding-back member 3D upside down and attaching it to the second striker 4D.

Furthermore, in the belt adjusting and holding device 10D in the fourth example, preferably, the fifth raised portions 412DT1 are each formed, on the front end side, with a fifth inclined surface 412DT2 inclined front-upward toward the upper inner wall surface 412D of the third belt insertion part 41D, and the sixth raised portions 413DT1 are each formed, on the front end side, with a sixth inclined surface 413DT2 inclined front-downward toward the lower inner wall surface 413D of the third belt insertion part 41D.

In this case, for example, when the third belt folding-back member 3D not turned upside down is moved from the forward position to the backward position, the third belt 1M bent by the third protrusions 33D formed on the upper end face 312D of the third folding-back part 31D presses upward the fifth raised portions 412DT1 through the fifth inclined surfaces 412DT2, and the third belt 1M bent by the third protrusions 33D formed on the lower end face 313D of the third folding-back part 31D presses downward the six first raised portions 413DT1 through the sixth inclined surfaces 413DT2, resiliently warping the upper inner wall surface 412D and the lower inner wall surface 413D of the third belt insertion part 41D to easily expand the gap between these inner wall surfaces. This can reduce the force needed to move the third belt folding-back member 3D from the forward position to the backward position, so that the length of the third belt 1M can be adjusted with respect to the second striker 4D with less operating force.

Furthermore, in the belt adjusting and holding device 10D in the fourth example, preferably, the fifth raised portions 412DT1 are each formed, on the front end side, with a fifth inclined surface 412DT2 inclined front-upward toward the upper inner wall surface 412D of the third belt insertion part 41D, and the sixth raised portions 413DT1 are each formed, on the front end side, with a sixth inclined surface 413DT2 inclined front-downward toward the lower inner wall surface 413D of the third belt insertion part 41D.

In this case, for example, when the third belt folding-back member 3D not turned upside down is moved from the forward position to the backward position, the third belt 1M bent by the third protrusions 33D formed on the upper end face 312D of the third folding-back part 31D presses upward the fifth raised portions 412DT1 through the fifth inclined surfaces 412DT2, and the third belt 1M bent by the third protrusions 33D formed on the lower end face 313D of the third folding-back part 31D presses downward the six first raised portions 413DT1 through the sixth inclined surfaces 413DT2, resiliently warping the upper inner wall surface 412D and the lower inner wall surface 413D of the third belt insertion part 41D to easily expand the gap between these inner wall surfaces. This can reduce the force needed to move the third belt folding-back member 3D from the forward position to the backward position, so that the length of the third belt 1M can be adjusted with respect to the second striker 4D with less operating force.

<Operations and Effects>

As described above in detail, the belt adjusting and holding device 10, 10B, 10C, 10D in the present embodiment includes the device body 2, 2B, 2C, 2D and the belt folding-back member 3. The device body 2, 2B, 2C, 2D includes the belt insertion part 21 formed in the back end portion 211 and opening in a substantially rectangular shape to allow the belt 1 to be inserted forward and the opening section 22 having a substantially rectangular shape, communicating with the belt insertion part 21, and extending through in the upper-lower direction R2 perpendicular to the insertion direction of the belt 1. The belt folding-back member 3 having a substantially plate shape configured to move forward and backward in the front-back direction R1 within the device body 2, 2B, 2C, 2D includes the folding-back part 31 configured to allow the belt 1 to wind around the front end 311 and fold backward within the opening section 22, and the grasping part 32 located on the back end side of the folding-back part 31 and configured to project backward from the belt insertion part 21 together with the folded belt 1. The belt insertion part 21 includes the upper inner wall surface 212 and the lower inner wall surface 213 which are respectively formed with the standing wall portion 212T and the standing wall portion 213T, each rising inward in a stepped shape on the opening section 22 side and extending almost continuously in the belt width direction R3 between the right and left sidewalls 23. The folding-back part 31 includes the upper end face 312 and the lower end face 313, at least one of which is formed with the protrusions 33, which are disposed near back of the standing wall portion 212T or 213T when the belt folding-back member 3 is moved to the backward position P1, bending the belt 1 into a substantially stepped shape between the standing wall portions 212T and 213T, and which are disposed in the opening section 22 when the belt folding-back member 3 is moved to the forward position P2, releasing the belt 1 from bending. Accordingly, when fixing the belt 1 to the device body 2, 2B, 2C, 2D, the belt folding-back member 3 is moved together with the folded belt 1 to the backward position P1, thereby bending the belt 1 into a substantially stepped shape between the standing wall portions 212T and 213T and the protrusions 33, so that the belt 1 is prevented from moving by its deformation resistance. The belt folding-back member 3 is not allowed to move backward more than the backward position P1 relative to the device body 2, 2B, 2C, 2D. Thus, even if the belt 1 is pulled strongly, the belt 1 does not move with respect to the device body 2. Therefore, by simply moving the belt folding-back member 3 together with the folded belt 1 to the backward position P1, the belt 1 can be easily fixed to the device body 2, 2B, 2C, 2D.

In order to adjust the length of the belt 1 with respect to the device body 2, 2B, 2C, 2D, it is only necessary to move the belt folding-back member 3 together with the folded belt 1 to the forward position P2. Specifically, when the belt folding-back member 3 is moved to the forward position P2, the protrusions 33 of the folding-back part 31 are moved into the opening section 22, and therefore the belt 1 wound around the folding-back part 31 of the belt folding-back member 3 moved to the forward position P2 is released from restraint between the protrusions 33 and the standing wall portions 212T and 213T, so that the belt 1 is allowed to freely move within the opening section 22. Thus, the length of the belt 1 can be easily adjusted with respect to the device body 2, 2B, 2C, 2D by simply moving the belt folding-back member 3 together with the folded belt 1 to the forward position P2.

While the belt folding-back member 3, which has been moved together with the folded belt 1, is disposed at the backward position P1, the belt 1 is bent in a substantially stepped shape between the standing wall portions 212T and 213T and the protrusions 33. To move this belt folding-back member 3 from the backward position P1 to the forward position P2, it is necessary to apply a force to cause the protrusions 33 to pass over the standing wall portions 212T and 213T together with the bent belt 1. The belt folding-back member 3 is therefore locked at the backward position P1 through the bent belt 1. Accordingly, even when the belt 1 is not in use, the belt 1 is not displaced with respect to the device body 2, 2B, 2C, 2D, thus eliminating the need for readjustment of the belt adjusting and holding device 10, 10B, 10C, 10D each time the belt 1 is used.

Since the device body 2, 2B, 2C, 2D includes the belt insertion part 21 formed in the back end portion 211 and opening in a substantially rectangular shape to allow the belt 1 to be inserted forward and the substantially rectangular opening section 22 communicating with the belt insertion part 21 and extending in the upper-lower direction R2 perpendicular to the insertion direction of the belt 1, and the substantially plate-shaped belt folding-back member 3 configured to move forward and backward in the front-back direction R1 within the device body 2, 2B, 2C, 2D includes the folding-back part 31 configured to allow the belt 1 to wind around the front end 311 and fold back within the opening section 22 and the grasping part 32 located on the back end side of the folding-back part 31 and configured to project backward from the belt insertion part 21 together with the folded belt 1, when the folding-back part 31 of the belt folding-back member 3 has the thickness d1 in the upper-lower direction R2 set to a minimum thickness needed for folding back the belt 1, the thickness d2 of the device can be easily prevented from becoming excessive.

Therefore, the belt adjusting and holding device 10, 10B, 10C, 10D in the present embodiment can be provided without an excessive device thickness and capable of easily adjusting the length of the belt 1 and holding the adjusted belt 1, thus eliminating the need for readjustment at each use.

According to the present embodiment, the upper end face 312 and the lower end face 313 of the folding-back part 31 are parallel to each other, the protrusions 33 each include the front wall surface 331 facing forward and vertically extending from the upper end face 312 or the lower end face 313 and the rear inclined surface 332 inclined obliquely forward at an acute angle relative to the upper end face 312 or the lower end face 313. Accordingly, when the belt folding-back member 3 is moved from the forward position P2 to the backward position P1, the rear inclined surfaces 332 of the protrusions 33 press against the standing wall portions 212T and 213T, thereby resiliently warping the upper inner wall surface 212 and the lower inner wall surface 213 of the belt insertion part 21, so that the gap between these inner wall surfaces is easily expanded. This can reduce the force needed to move the belt folding-back member 3 from the forward position P2 to the backward position P1 and thus the belt 1 can be fixed to the device body 2, 2B, 2C, 2D with less operating force.

On the other hand, each protrusion 33 includes the front wall surface 331 facing forward and vertically extending from the upper end face 312 or the lower end face 313 of the folding-back part 31. Thus, when the belt folding-back member 3 is moved together with the folded belt 1 to the backward position P1, the belt 1 can be bent at an angle near a right angle between the standing wall portions 212T and 213T and the front wall surface 331, thus increasing the deformation resistance thereof. Therefore, when the belt folding-back member 3 is moved to the backward position P1, the belt 1 can be firmly fixed to the device body 2, 2B, 2C, 2D with a crisp feel.

According to the present embodiment, the protrusions 33 are provided on the upper end face 312 and the lower end face 313 of the folding-back part 31, at different positions between the upper and lower end faces in the belt width direction R3, the standing wall portion 212T formed on the upper inner wall surface 212 is formed with the first raised portions 212T1 protruding inward at the positions facing the protrusions 33 formed on the upper end face 312 of the folding-back part 31, and the standing wall portion 213T formed on the lower inner wall surface 213 is formed with the second raised portion 213T1 protruding inward at a position facing the protrusion 33 formed on the lower end face 313 of the folding-back part 31. Accordingly, while the belt folding-back member 3 not turned upside down is disposed together with the folded belt 1 to the backward position P1, the gaps between the first raised portions 212T1 and the upper end face 312 of the folding-back part 31 at the positions where the first raised portions 212T1 face the corresponding protrusions 33 are narrowed just by the height of the first raised portions 212T1, and further the gaps between the second raised portions 213T1 and the lower end face 313 of the folding-back part 31 at the positions where the second raised portions 213T1 face the corresponding protrusions 33 are narrowed just by the height of the second raised portions 213T1. Therefore, even the belt 1 having a relatively thinner thickness than the gap between the standing wall portions 212T and 213T and the folding-back part 31 can be bent into a substantially stepped shape between the protrusions 33 of the folding-back part 31 and the first raised portions 212T1 and the second raised portions 213T1 of the belt insertion part 21. Thus, even the thin belt 1 can be firmly fixed to the device body 2, 2B, 2C, 2D.

In contrast, the belt folding-back member 3 is configured to move, in an upside-down state, forward and backward in the front-back direction R1 within the device body 2, 2B, 2C, 2D. Accordingly, when the belt folding-back member 3 is turned upside down with respect to the device body 2, 2B, 2C, 2D, the protrusions 33 of the folding-back part 31 are arranged at different positions in the belt width direction R3 with respect to the first raised portions 212T1 and the second raised portions 213T1 of the belt insertion part 21. Thus, while the upside-down belt folding-back member 3, which has been moved together with the folded belt 1, is disposed at the backward position P1, this belt 1 can be bent in a substantially stepped shape between the standing wall portions 212T and 213T and the protrusions 33 without being influenced by the first raised portions 212T1 and the second raised portions 213T1, so that the belt 1 is prevented from moving by its deformation resistance. When the upside-down belt folding-back member 3 is moved to the backward position P1, the belt folding-back member 3 can more firmly fix a thick belt 1 to the device body 2, 2B, 2C, 2D as compared with the belt folding-back member 3 not turned upside down. As a result, a single belt adjusting and holding device 10, 10B, 10C, 10D can adjust the length of different belts 1 of different thicknesses and hold the adjusted belt 1 by simple operation of turning the belt folding-back member 3 upside down and attaching it to the device body 2, 2B, 2C, 2D.

According to the present embodiment, the first raised portions 212T1 are each formed, on the back end side, with the first inclined surface 212T2 inclined back-upward toward the upper inner wall surface 212, and the second raised portions 213T1 are each formed, on the back end side, with the second inclined surface 213T2 inclined downward and backward toward the lower inner wall surface 213. Therefore, when the belt folding-back member 3 not turned upside down is moved from the backward position P1 to the forward position P2, the belt 1 bent by the protrusions 33 formed on the upper end face 312 of the folding-back part 31 presses upward the first raised portions 212T1 through the first inclined surfaces 212T2, and the belt 1 bent by the protrusions 33 formed on the lower end face 313 of the folding-back part 31 presses downward the second raised portions 213T1 through the second inclined surfaces 213T2, resiliently warping the upper inner wall surface 212 and the lower inner wall surface 213 of the belt insertion part 21 to easily expand the gap between these inner wall surfaces. This can reduce the force needed to move the belt folding-back member 3 from the forward position P2 to the backward position P1 and thus the length of the belt 1 can be adjusted with respect to the device body 2, 2B, 2C, 2D with less operating force.

According to the present embodiment, furthermore, the right and left sidewalls 23 of the device body 2, 2B, 2C, 2D are each formed with the guide groove 231 extending in the front-back direction R1 to guide movement of the belt folding-back member 3 between the forward position P2 and the backward position P1. The folding-back part 31 is formed, at right and left outer edges, with the guide projections 314 which engage with the guide grooves 231. Further, the folding-back part 31 includes the right and left portions separated at the center in the belt width direction R3 and joined to each other in the nearly U shape through the grasping part 32. Accordingly, by vertically displacing the separated right and left portions of the folding-back part 31 and overlapping their central portions one on the other to engage the guide projections 314 of the folding-back part 31 into the guide grooves 231 of the sidewalls 23 of the device body 2, 2B, 2C, 2D, the belt folding-back member 3 can be easily attached to the device body 2, 2B, 2C, 2D. Furthermore, by moving the guide projections 314 to the front ends of the guide grooves 231, the belt folding-back member 3 can be moved to the forward position P2, thereby easily adjusting the length of the belt 1. In contrast, by moving the guide projections 314 to the back ends of the guide grooves 231, the belt folding-back member 3 can be moved to the backward position P1, thereby easily fixing the belt 1. This configuration enables to easily attach the belt folding-back member 3 to the device body 2, 2B, 2C, 2D, easily adjust the length of the belt 1, and fix the adjusted belt 1 to the device body 2, 2B, 2C, 2D.

According to the present embodiment, there is provided with the striker 4 including the proximal end portion 41 to which the belt 1K for length fixation is fixed and the distal end portion 42 formed with the locking pawls 421. The device body 2 includes, on the front end side of the opening section 22, the striker housing part 24 configured to detachably hold the striker 4, and the engaging protrusions 241 located in the striker housing part 24 and configured to engage with the locking pawls 421 of the striker 4. Thus, the belt 1 for length adjustment can be fixed with an adjustable length on the back end side of the device body 2 through the belt folding-back member 3, while the belt 1K for length fixation can be detachably connected to the device body 2 through the striker 4 in the striker housing part 24 formed on the front end side of the device body 2. Therefore, the belt folding-back member 3 and the striker 4 can be arranged adjacent to each other in the front-back direction R1 of the device body 2, without overlapping one on the other in the upper-lower direction R2. As a result, the device can be slimmed, thus resulting in an improved external appearance and an enhanced handleability and operability.

According to the present embodiment, the device body 2B includes the belt fixing frame 25 on the front end side of the opening section 22, the fixing frame 25 being configured to fix thereto a belt 1K for length fixation. Thus, the belt 1 for length adjustment can be fixed with the adjustable length on the back end side of the device body 2B through the belt folding-back member 3, while the belt 1K for length fixation can be fixed on the front end side of the device body 2B through the belt fixing frame 25. Thus, the device body 2B for connecting both the belts 1 and 1K can be downsized and slimmed, resulting in an improved handleability and operability in use. Consequently, the belt adjusting and holding device 10B can be provided without an excessive device thickness and capable of easily adjusting the length of the belt 1 and holding the adjusted belt 1.

According to the present embodiment, the device body 2C includes the second belt insertion part 21C formed on the front end side of the opening section 22 and opening in a substantially rectangular shape to allow backward insertion of the second belt 1L for length adjustment. The second belt folding-back member 3C having a substantially plate shape and configured to move forward and backward in the front-back direction R1 within the device body 2C includes the second folding-back part 31C configured to allow the second belt 1L to wind around the back end 311C and fold forward, within the opening section 22, and the second grasping part 32C located on the front end side of the second folding-back part 31C and configured to project forward from the second belt insertion part 21C together with the folded second belt 1L. The second belt insertion part 21C is formed, on the upper inner wall surface 212C and the lower inner wall surface 213C, with the second standing wall portions 212CT and 213CT, each rising inward in a stepped shape on the side near the opening section 22 and extending almost continuously in the belt width direction R3 between the right and left sidewalls 23. The second folding-back part 31C includes the upper end face 312C and the lower end face 313C, at least one of which is formed with the second protrusions 33C, which are disposed near front of the second standing wall portion 212CT or 213CT when the second belt folding-back member 3C is moved to the forward position, bending the second belt 1L into a substantially stepped shape between the second standing wall portions 212CT and 213CT, and which are disposed in the opening section 22 when the second belt folding-back member 3C is moved to the backward position, releasing the second belt 1L from bending. When fixing the second belt 1L to the device body 2C, the second belt folding-back member 3C is moved to the forward position together with the folded second belt 1L, bending the second belt 1L into a substantially stepped shape between the second standing wall portions 212CT and 213CT and the second protrusions 33C, so that the second belt 1L is prevented from moving by its deformation resistance. Furthermore, since the second belt folding-back member 3C is not allowed to move forward more than the forward position relative to the device body 2C, even when the second belt 1L is pulled strongly, the second belt 1L does not move with respect to the device body 2C. Therefore, by simply moving the second belt folding-back member 3C together with the second belt 1L to the forward position, the second belt 1L can be easily fixed to the device body 2C.

In order to adjust the length of the second belt 1L with respect to the device body 2C, it is only necessary to move the second belt folding-back member 3C together with the folded second belt 1L to the backward position. Specifically, when the second belt folding-back member 3C is moved to the backward position, the second protrusions 33C are moved into the opening section 22, and therefore the second belt 1L wound around the second folding-back part 31C of the second belt folding-back member 3C moved to the backward position is released from bending by the second protrusions 33C and the second standing wall portions 212CT or 213CT, so that the second belt 1L is allowed to freely move within the opening section 22. Thus, the length of the second belt 1L can be easily adjusted with respect to the device body 2C by simply moving the second belt folding-back member 3C together with the folded second belt 1L to the backward position.

While the second belt folding-back member 3C, which has been moved together with the folded second belt 1L, is disposed at the forward position, the second belt 1L is bent in a substantially stepped shape between the second standing wall portions 212CT and 213CT and the protrusions 33C. To move this second belt folding-back member 3C from the forward position to the backward position, it is necessary to apply a force to cause the second protrusions 33C to pass over the second standing wall portions 212CT and 213CT together with the second belt 1L. The second belt folding-back member 3C is therefore locked at the forward position through the bent second belt 1L. Accordingly, even when the second belt 1L is not in use, the second belt 1L is not displaced with respect to the device body 2C, thus eliminating the need for readjustment of the belt adjusting and holding device 10C each time the second belt 1L is used.

Since the device body 2C includes the second belt insertion part 21C formed on the front end side of the opening section 22 and opening in a substantially rectangular shape to allow backward insertion of the second belt 1L for length adjustment, and the second belt folding-back member 3C, which has a substantially plate shape and is configured to move forward and backward in the front-back direction R1 within the device body 2C, includes the second folding-back part 31C configured to allow the second belt 1L to wind around the back end 311C and fold forward within the opening section 22, and the second grasping part 32C located on the front end side of the second folding-back part 31C and configured to project forward from the second belt insertion part 21C together with the folded second belt 1L, when the second folding-back part 31C has the thickness in the upper-lower direction R2 set to a minimum thickness needed for folding back the second belt 1L, the thickness of the device can be easily prevented from becoming excessive. Therefore, the belt adjusting and holding device 10C in the present embodiment can be provided without an excessive device thickness and capable of easily adjusting and holding the lengths of the belts 1 and 1L, eliminating the need for readjustment at each use.

According to the present embodiment, the second protrusions 33C are arranged on the upper end face 312C and the lower end face 313C of the second folding-back part 31C, at different positions in the belt width direction R3 for each end face. The second standing wall portion 212CT formed on the upper inner wall surface 212C of the second belt insertion part 21C is formed with the third raised portions 212CT1 protruding inward at the positions facing the second protrusions 33C formed on the upper end face 312C of the second folding-back part 31C. The second standing wall portion 213CT formed on the lower inner wall surface 213C of the second belt insertion part 21C is formed with the fourth raised portions 213CT1 protruding inward at the positions facing the second protrusions 33C formed on the lower end face 313C of the second folding-back part 31C. Accordingly, while the second belt folding-back member 3C, not turned upside down, moved together with the folded second belt 1L is disposed at the forward position, the gaps between the third raised portions 212CT1 and the upper end face 312C of the second folding-back part 31C are narrowed just by the height of the third raised portions 212CT1 at the positions where the third raised portion 212CT1 face the corresponding second protrusions 33C, and the gaps between the fourth raised portions 213CT1 and the lower end face 313C of the second folding-back part 31C are narrowed just by the height of the fourth raised portions 213CT1 at the positions where the fourth raised portions 213CT1 face the corresponding second protrusions 33C. Therefore, even the belt 1L having a relatively tinner thickness than the gap between each standing wall portion 212CT and 213CT and the second folding-back part 31C can be bent into a substantially stepped shape between the second protrusions 33C and the third raised portion 212CT1 and between the second protrusions 33C and the fourth raised portion 213CT1. Thus, even the thin belt 1L can be firmly fixed to the device body 2C.

In contrast, since the second belt folding-back member 3C is configured to move, in an upside-down orientation, forward and backward in the second device body 2C, when the second belt folding-back member 3C is turned upside down with respect to the second device body 2C, the second protrusions 33C are arranged at different positions in the belt width direction R3 with respect to the third raised portion 212CT1 and the fourth raised portion 213CT1. Thus, while the upside-down second belt folding-back member 3C, which has been moved together with the folded second belt 1L, is disposed at the forward position, this belt 1L is bent in a substantially stepped shape between the second standing wall portions 212CT and 213CT and the second protrusions 33C without being influenced by the third raised portions 212CT1 and the fourth raised portions 213CT1, so that the second belt 1L is prevented from moving by its deformation resistance. When the second belt folding-back member 3C in the upside-down state is moved to the forward position, this second belt folding-back member 3C can more firmly fix the thick belt 1L to the device body 2C as compared with the second belt folding-back member 3C not turned upside down. As a result, a single belt adjusting and holding device 10C can adjust the length of different belts 1L of different thicknesses and hold the adjusted belt 1L by simple operation of turning the second belt folding-back member 3C upside down and attaching it to the device body 2C.

According to the present embodiment, there is provided with the second striker 4D having the proximal end portion 4K to which the third belt 1M for length adjustment is fixed with an adjustable length, and the distal end portion 42 formed with the locking pawls 421. The device body 2D includes, on the front end side of the opening section 22, the striker housing part 24 configured to detachably hold the second striker 4D, and the engaging protrusions 241 located in the striker housing part 24 and configured to engage with the locking pawls 421 of the second striker 4D. Accordingly, the belt 1 for length adjustment can be fixed with an adjustable length to the back end side of the device body 2D through the belt folding-back member 3, while the third belt 1M for length adjustment can be detachably connected with an adjustable length to the device body 2D through the second striker 4D in the striker housing part 24 formed on the front end side of the device body 2D. Therefore, the belt folding-back member 3 and the second striker 4D can be arranged adjacent to each other in the front-back direction R1 of the device body 2D, without overlapping one on the other in the upper-lower direction R2. As a result, the device can be slimmed, thus resulting in an improved external appearance and an enhanced handleability and operability.

According to the present embodiment, the proximal end portion 4K of the second striker 4D is provided with the third belt insertion part 41D opening in a substantially rectangular shape to allow backward insertion of the third belt 1M from the front end portion 411D, and the second opening section 42D having a substantially rectangular shape, communicating with the third belt insertion part 41D, and extending through in the upper-lower direction R2 perpendicular to the insertion direction of the third belt 1M. The belt adjusting and holding device 10D includes the third belt folding-back member 3D having a substantially plate shape configured to move forward and backward in the front-back direction R1 within the second striker 4D. The third belt folding-back member 3D includes the third folding-back part 31D configured to allow the third belt 1M to wind around the back end 311D and fold forward, and the third grasping part 32D located on the front end side of the third folding-back part 31D and configured to project forward from the third belt insertion part 41D together with the folded third belt 1M. The third belt insertion part 41D includes the upper inner wall surface 412D and the lower inner wall surface 413D which are respectively formed with the third standing wall portions 412DT and 413DT, each rising inward in a stepped shape on the side near the second opening section 42D and extending almost continuously in the belt width direction R3 between the right and left sidewalls 43D of the second striker 4D. The third folding-back part 31D includes the upper end face 312D and the lower end face 313D, at least one of which is formed with the third protrusions 33D, which are disposed rear front of of the third standing wall portions 412DT and 413DT when the third belt folding-back member 3D is moved to the forward position of the third belt folding-back member 3D, bending the third belt 1M into a substantially stepped shape between the third standing wall portions 412DT and 413DT, and which are disposed in the second opening section 42D when the third belt folding-back member 3D is moved to the backward position, releasing the third belt 1M from bending. When fixing the third belt 1M to the second striker 4D, the third belt folding-back member 3D is moved to the forward position together with the folded third belt 1M, bending the third belt 1M into a substantially stepped shape between the third standing wall portions 412DT and 413DT, so that the third belt 1M is prevented from moving by its deformation resistance. Furthermore, since the third belt folding-back member 3D is not allowed to move forward more than the forward position relative to the second striker 4D, even when the third belt 1M is pulled strongly, the third belt 1M does not move with respect to the second striker 4D. Therefore, by simply moving the third belt folding-back member 3D together with the folded third belt 1M to the forward position, the third belt 1M can be easily fixed to the second striker 4D.

In order to adjust the length of the third belt 1M with respect to the second striker 4D, it is only necessary to move the third belt folding-back member 3D together with the folded third belt 1M to the backward position. Specifically, when the third belt folding-back member 3D is moved to the backward position, the third protrusions 33D are moved into the second opening section 42D, and therefore the third belt 1M wound around the third folding-back part 31D of the third belt folding-back member 3D moved to the backward position is released from bending by the third protrusions 33D and the third standing wall portions 412DT and 413DT, so that the third belt 1M is allowed to freely move within the second opening section 42D. Thus, the length of the third belt 1M can be easily adjusted with respect to the second striker 4D by simply moving the third belt folding-back member 3D together with the folded third belt 1M to the backward position.

While the third belt folding-back member 3D, which has been moved together with the folded third belt 1M, is disposed at the forward position, the third belt 1M is bent in a substantially stepped shape between the third standing wall portions 412DT and 413DT and the third protrusions 33D. To move this third belt folding-back member 3D from the forward position to the backward position, it is necessary to apply a force to cause the third protrusions 33D to pass over the third standing wall portions 412DT and 413DT together with the bent third belt 1M. The third belt folding-back member 3D is therefore locked at the forward position through the bent third belt 1M. Accordingly, even when the third belt 1M is not in use, the third belt 1M is not displaced with respect to the second striker 4D, thus eliminating the need for readjustment of the belt adjusting and holding device 10D in this example each time the third belt 1M is used.

Since the second striker 4D is provided, on the front end side of the second opening section 42D, with the third belt insertion part 41D opening in a substantially rectangular shape to allow backward insertion of the third belt 1M for length adjustment, the third belt folding-back member 3D having a substantially plate shape and configured to move forward and backward in the front-back direction R1 within the second striker 4D includes the third folding-back part 31D configured to allow the third belt 1M to wind around the back end 311D and fold forward within the second opening section 42D, and the third grasping part 32D located on the front end side of the third folding-back part 31D and configured to project forward from the third belt insertion part 41D together with the folded third belt 1M, when the third folding-back part 31D has the thickness in the upper-lower direction R2 set to a minimum thickness needed for folding back the third belt 1M, the thickness of the device can be easily prevented from becoming excessive. Therefore, the belt adjusting and holding device 10D can be provided without an excessive device thickness and capable of easily adjusting and holding the lengths of the belts 1 and 1M, eliminating the need for readjustment at each use.

According to the present embodiment, the third protrusions 33D are arranged on the upper end face 312D and the lower end face 313D of the third folding-back part 31D, at different positions in the belt width direction R3 for each end face. The third standing wall portion 412DT formed on the upper inner wall surface 412D of the third belt insertion part 41D is formed with the fifth raised portions 412DT1 protruding inward at the positions facing the third protrusions 33D formed on the upper end face 312D of the third folding-back part 31D. The third standing wall portion 413DT formed on the lower inner wall surface 413D of the third belt insertion part 41D is formed with the sixth raised portions 413DT1 protruding inward at the positions facing the third protrusions 33D formed on the lower end face 313D of the third folding-back part 31D. The third belt folding-back member 3D is configured to move, in an upside-down state, forward and backward in the front-back direction R1 within the second striker 4D. While the third belt folding-back member 3D, not turned upside down, moved together with the folded third belt 1M is disposed at the forward position, the gaps between the fifth raised portions 412DT1 and the upper end face 312D of the third folding-back part 31D are narrowed just by the height of the fifth raised portions 412DT1 at the positions where the fifth raised portions 412DT1 face the corresponding third protrusions 33D, and the gaps between the sixth raised portions 413DT1 and the lower end face 313D of the third folding-back part 31D are narrowed just by the height of the six raised portions 413DT1 at the positions where the sixth raised portions 413DT1 and the corresponding third protrusions 33D. Therefore, even the third belt 1M having a relatively thinner thickness than the gap between each standing wall portion 412DT and 413DT and the third folding-back part 31D can be bent into a substantially stepped shape between the third protrusions 33D and the fifth raised portions 412DT1 and between the third protrusions 33D and the sixth raised portions 413DT1. Thus, even the thin belt 1M can be firmly fixed to the second striker 4D.

In contrast, when the third belt folding-back member 3D is turned upside down with respect to the second striker 4D, the third protrusions 33D are arranged at different positions in the belt width direction R3 with respect to the fifth raised portions 412DT1 and the sixth raised portions 413DT1. Thus, while the upside-down third belt folding-back member 3D, which has been moved together with the folded third belt 1M, is disposed at the forward position, this third belt 1M can be bent in a substantially stepped shape between the third standing wall portions 412DT and 413DT and the third protrusions 33D without being influenced by the fifth raised portions 412DT1 and the sixth raised portions 413DT1, so that the third belt 1M is prevented from moving by its deformation resistance. When the third belt folding-back member 3D in the upside-down state is moved to the forward position, this third belt folding-back member 3D can more firmly fix the thick belt 1M to the second striker 4D as compared with the third belt folding-back member 3D not turned upside down. As a result, a single belt adjusting and holding device 10D can adjust the length of different third belts 1M of different thicknesses and hold the adjusted belt 1M by simple operation of turning the third belt folding-back member 3D upside down and attaching it to the second striker 4D.

<Modified Examples>

The foregoing embodiments described in detail may be appropriately modified or changed without departing from the essential characteristics of the present invention. For instance, in the belt adjusting and holding device 10 in the first example, the protrusions 33 are provided on the upper end face 312 and the lower end face 313 of the folding-back part 31, at different positions in the belt width direction R3 for each end face, the standing wall portion 212T formed on the upper inner wall surface 212 is formed with the first raised portions 212T1 protruding inward at the positions facing the protrusions 33 formed on the upper end face 312 of the folding-back part 31, and the standing wall portion 213T of the lower inner wall surface 213 is formed with the second raised portions 213T1 protruding inward at the positions facing the protrusions 33 formed on the lower end face 313 of the folding-back part 31. However, the present invention is not limited to this configuration.

For example, the protrusions 33 may be provided on the upper end face 312 and the lower end face 313 of the folding-back part 31, at same positions in the belt width direction R3 between the end faces. Further, either or both of the standing wall portions 212T and 213T may not be provided with the first raised portions 212T1 or the second raised portions 213T1.

INDUSTRIAL APPLICABILITY

The present invention is utilizable as a belt adjusting and holding device, which is used as for example a buckle of a belt for pants or trousers or a tool for tightening belts or straps of a backpack, a belted bag, a waist pouch, a helmet, etc., and configured to adjust the length of at least one belt or strap and hold the belt with an adjusted length.

REFERENCE SIGNS LIST

1, 1K, 1L, 1M Belt
2, 2B, 2C, 2D Device body
3, 3C, 3D Belt folding-back member
4, 4D Striker
4K Proximal end portion
10, 10B, 10C, 10D Belt adjusting and holding device
21, 21C, 41D Belt insertion part
22, 42D Opening section
23, 43D Sidewall
24 Striker housing part
25 Belt fixing frame
31, 31C, 31D Folding-back part
32, 32C, 32D Grasping part
33, 33C, 33D Protrusion
41 Proximal end portion
42 Distal end portion
211 Back end portion
212, 212C, 412D Upper inner wall surface
212T, 212CT, 412DT Standing wall portion
212T1 First raised portion
212T2 First inclined surface
212CT1 Third raised portion
212CT2 Third inclined surface
213, 213C, 413D Lower inner wall surface
213T, 213CT, 413DT Standing wall portion
213T1 Second raised portion
213T2 Second inclined surface
213CT1 Fourth raised portion
213CT2 Fourth inclined surface
231, 431D Guide groove
241 Engaging protrusion
311 Front end
311C, 311D Back end
312, 312C, 312D Upper end face
313, 313C, 313D Lower end face
314, 314D Guide projection
331 Front wall surface
332 Rear inclined surface
411D Front end portion
421 Locking pawl

The invention claimed is:

1. A belt adjusting and holding device configured to adjust a length of at least one belt and hold the adjusted belt, the device comprising:

a device body including:

a belt insertion part formed in a back end portion and opening in a substantially rectangular shape to allow the belt to be inserted forward; and an opening section having a substantially rectangular shape, communicating with the belt insertion part, and extending through in an upper-lower direction perpendicular to an insertion direction of the belt; and a belt folding-back member having a substantially plate shape configured to move forward and backward in a front-back direction within the device body, the belt folding-back member comprising:

a folding-back part configured to allow the belt to wind around a front end and fold backward within the opening section; and a grasping part located on a back end side of the folding-back part and configured to project backward from the belt insertion part together with the folded belt, wherein the belt insertion part includes an upper inner wall surface and a lower inner wall surface which are formed with standing wall portions rising inward in a stepped shape on a side near the opening section and extending almost continuously in a belt width direction between right and left sidewalls, and the folding-back part includes an upper end face and a lower end face, at least one of which is formed with a protrusion, which is disposed near a back of the standing wall portion when the belt folding-back member is moved to a backward position, bending the belt into a substantially stepped shape between the protrusion and the standing wall portion, and which is disposed in the opening section when the belt folding-back member is moved to a forward position, releasing the belt from bending.

2. The belt adjusting and holding device according to claim 1, wherein the upper end face and the lower end face of the folding-back part are parallel to each other, and the protrusion includes:

a front wall surface facing forward and vertically extending from the upper end face or the lower end face; and a rear inclined surface inclined obliquely forward at an acute angle relative to the upper end face or the lower end face.

3. The belt adjusting and holding device according to claim 1, wherein the protrusion includes a plurality of protrusions provided on the upper end face and the lower end face of the folding-back part, at different positions between the upper and lower end faces in the belt width direction, the standing wall portion formed on the upper inner wall surface is formed with a first raised portion protruding inward at a position facing the protrusion formed on the upper end face of the folding-back part, the standing wall portion formed on the lower inner wall surface is formed with a second raised portion protruding inward at a position facing the protrusion formed on the lower end face of the folding-back part, and the belt folding-back member is configured to move, in an upside-down state, forward and backward in the front-back direction within the device body.

4. The belt adjusting and holding device according to claim 3, wherein the first raised portion is formed, on a back end side, with a first inclined surface inclined back-upward toward the upper inner wall surface, and the second raised portion is formed, on a back end side, with a second inclined surface inclined back-downward toward the lower inner wall surface.

5. The belt adjusting and holding device according to claim 1, wherein the right and left sidewalls of the device body are each formed with a guide groove extending in the front-back direction to allow the belt folding-back member to be movable between the forward position and the backward position, the folding-back part is formed, at right and left outer edges, with guide projections which engage with the guide grooves, and the folding-back part includes right and left portions separated at a center in the belt width direction and joined to each other in a nearly U shape through the grasping part.

6. The belt adjusting and holding device according to claim 1, further comprising a striker including a proximal end portion to which a belt for length fixation is fixed and a distal end portion formed with a locking pawl, wherein the device body includes a striker housing part on a front end side of the opening section to detachably hold the striker, and an engaging protrusion located in the striker housing part and configured to engage with the locking pawl of the striker.

7. The belt adjusting and holding device according to claim 1, wherein the device body includes a belt fixing frame on a front end side of the opening section, the belt fixing frame being configured to fix thereto a belt for length fixation.

8. The belt adjusting and holding device according to claim 1, wherein the device body includes a second belt insertion part formed on a front end side of the opening section and opening in a substantially rectangular shape to allow a second belt for length adjustment to be inserted backward, the belt adjusting and holding device further comprises a second belt folding-back member having a substantially plate shape configured to move forward and backward in the front-back direction in the device body, the second belt folding-back member including:

a second folding-back part configured to allow the second belt to wind around a back end and fold forward, within the opening section; and a second grasping part located on a front end side of the second folding-back part and configured to project forward from the second belt insertion part together with the folded second belt, the second belt insertion part includes an upper inner wall surface and a lower inner wall surface which are formed with second standing wall portions rising inward in a stepped shape on a side near the opening section and extending almost continuously in the belt width direction between the right and left sidewalls, and the second folding-back part includes an upper end face and a lower end face, at least one of which is is formed with a second protrusion, which is disposed near front of the second standing wall portion when the second belt folding-back member is moved to a forward position, bending the second belt into a substantially stepped shape between the second protrusion and the second standing wall portion, and which is disposed in the opening section when the second belt folding-back member is moved to a backward position, releasing the second belt from bending.

9. The belt adjusting and holding device according to claim 8, wherein the second protrusion includes a plurality of second protrusions arranged on the upper end face and the lower end face of the second folding-back part, at different positions between the upper and lower end faces in the belt width direction, the second standing wall portion formed on the upper inner wall surface of the second belt insertion part is formed with a third raised portion protruding inward at a position facing the second protrusion formed on the upper end face of the second folding-back part, the second standing wall portion formed on the lower inner wall surface of the second belt insertion part is formed with a fourth raised portion protruding inward at a position facing the second protrusion formed on the lower end face of the second folding-back part, and the second belt folding-back member is configured to move, in an upside-down state, forward and backward in the front-back direction within the second device body.

10. The belt adjusting and holding device according to claim 1, further comprising a second striker including a proximal end portion to which a third belt for length adjustment is fixed with an adjustable length, and a distal end portion formed with a locking pawl, wherein the device body includes a striker housing part on a front end side of the opening section to detachably hold the second striker, and an engaging protrusion located in the striker housing part and configured to engage with the locking pawl of the second striker.

11. The belt adjusting and holding device according to claim 10, wherein the proximal end portion of the second striker is provided with a third belt insertion part opening in a substantially rectangular shape to allow the third belt to be inserted backward from a front end portion, and a second opening section having a substantially rectangular shape, communicating with the third belt insertion part, and extending through in the upper-lower direction perpendicular to an insertion direction of the third belt, the belt adjusting and holding device further comprises a third belt folding-back member having a substantially plate shape configured to move forward and backward in the front-back direction in the second striker, the third belt folding-back member including:

a third folding-back part configured to allow the third belt to wind around a back end and fold forward, within the second opening section; and a third grasping part located on a front end side of the third folding-back part and configured to project forward from the third belt insertion part together with the folded third belt, the third belt insertion part includes an upper inner wall surface and a lower inner wall surface which are formed with third standing wall portions rising inward in a stepped shape on a side near the second opening section and extending almost continuously in the belt width direction between right and left sidewalls of the second striker, and the third folding-back part includes an upper end face and a lower end face, at least one of which is formed with a third protrusion, which is disposed near front of the third standing wall portion when the third belt folding-back member is moved to a forward position, bending the third belt into a substantially stepped shape between the third protrusion and the third standing wall portion, and which is disposed in the second opening section when the third belt folding-back member is moved to a backward position, releasing the third belt from bending.

12. The belt adjusting and holding device according to claim 11, wherein the third protrusion includes a plurality of third protrusions arranged on the upper end face and the lower end face of the third folding-back part, at different positions between the upper and lower end faces in the belt width direction, the third standing wall portion formed on the upper inner wall surface of the third belt insertion part is formed with a fifth raised portion protruding inward at a position facing the third protrusion formed on the upper end face of the third folding-back part, the third standing wall portion formed on the lower inner wall surface of the third belt insertion part is formed with a sixth raised portion protruding inward at a position facing the third protrusion formed on the lower end face of the third folding-back part, and the third belt folding-back member is configured to move, in an upside-down state, forward and backward in the front-back direction within the second striker.

* * * * *